US007824007B2

(12) United States Patent
Chikamoto et al.

(10) Patent No.: US 7,824,007 B2
(45) Date of Patent: Nov. 2, 2010

(54) LIQUID EJECTION DEVICE

(75) Inventors: Tadanobu Chikamoto, Nagoya (JP); Shuichi Tamaki, Nagoya (JP); Hiroshi Taira, Ichinomiya (JP); Akira Shinoda, Obu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 141 days.

(21) Appl. No.: 12/332,129

(22) Filed: Dec. 10, 2008

(65) Prior Publication Data

US 2009/0153615 A1 Jun. 18, 2009

(30) Foreign Application Priority Data

Dec. 13, 2007 (JP) ..... 2007-321471

(51) Int. Cl.
*B41J 2/165* (2006.01)

(52) U.S. Cl. ..... 347/33; 347/32

(58) Field of Classification Search ..... 347/33, 347/29, 32

See application file for complete search history.

(56) References Cited

U.S. PATENT DOCUMENTS 6,371,595 B1 * 4/2002 Takemoto et al. ..... 347/33
6,866,361 B2 3/2005 Kuki et al.

FOREIGN PATENT DOCUMENTS

JP 2004-142450 A 5/2004

* cited by examiner

*Primary Examiner*—Shih-wen Hsieh
(74) *Attorney, Agent, or Firm*—Baker Botts L.L.P.

(57) ABSTRACT

A liquid ejection device includes: a conveyance mechanism which conveys a recording medium in one direction; a plurality of liquid ejection heads each having an ejection face which has a plurality of ejection openings for ejecting liquid and faces the conveyance mechanism, the liquid ejection heads being arranged along the one direction; a plurality of wipers which respectively wipe the ejection faces; a holder which holds the wipers; a support which supports the holder; and a movement mechanism which moves the holder in a direction perpendicular to the one direction. The holder is displaceable in the one direction relative to the support. The holder has an intruder which intrudes into a gap between two liquid ejection heads adjacent to each other.

16 Claims, 15 Drawing Sheets

LIQUID EJECTION DEVICE

CROSS REFERENCE TO RELATED APPLICATION

The present application claims priority from Japanese Patent Application No. 2007-321471, which was filed on Dec. 13, 2007, the disclosure of which is herein incorporated by reference in its entirety.

BACKGROUND OF THE INVENTION

1. Field of the Invention

The present invention relates to a liquid ejection device having a liquid ejection head which ejects liquid.

2. Description of Related Art

Japanese Unexamined Patent Publication No. 142450/2004 (Tokukai 2004-142450) discloses an inkjet recording apparatus which is a liquid ejection device having a maintenance unit provided with a blade (wiper), a wiper roller, and purge caps. The maintenance unit of the inkjet recording apparatus first covers nozzle faces (ejection faces) with the purge caps respectively, and then applies suction to nozzles to draw, from the nozzles, ink containing dust or bubbles, thickened ink, or the like. Then, the maintenance unit wipes off ink adhered to the nozzle faces with the wiper roller and the blade each abutting the ejection faces while the maintenance unit moves in one direction from a purge position to a withdrawal position.

However, the inkjet recording apparatus of the above publication may cause a problem such that the maintenance unit possibly moves in a direction deviating from the one direction within a plane parallel to the nozzle faces, during its movement in the one direction from the purge position to the withdrawal position. Along with this movement of the maintenance unit, the wiper unfortunately moves in the direction deviating from the one direction, which produces a portion of the ejection face which the wiper fails to abut. As a result, ink adhered to the portion of the ejection face which the wiper fails to abut is left without being wiped off. In addition, the movement of the wiper in a direction deviating from the one direction causes another problem such that a portion of the wiper wipes an ink different from the ink which should be wiped off by that portion if the wiper moves in the one direction. This causes mixing of inks in that portion of the wiper.

To wipe the whole ejection faces and prevent ink mixing despite the movement of the wiper in a direction deviating from the one direction, a wiper may be provided for each of the ejection faces, and each wiper may be designed to be wider than each ejection face in a direction perpendicular to the one direction ("perpendicular direction"). However, through downsizing of the apparatus, two adjacent ejection faces are disposed more closely to each other in recent years, with a smaller gap between the two ejection faces. In this circumstance, it is difficult to widen the width of each wiper in the perpendicular direction than that of each ejection face.

SUMMARY OF THE INVENTION

An object of the present invention is to provide a liquid ejection device capable of ensuring wiping of ejection faces while maintaining the positions of the wipers in relation to the ejection faces.

A liquid ejection device according to the present invention includes: a conveyance mechanism which conveys a recording medium in one direction; a plurality of liquid ejection heads each having an ejection face which has a plurality of ejection openings for ejecting liquid and faces the conveyance mechanism, the liquid ejection heads being arranged along the one direction; a plurality of wipers which wipe the ejection faces of the liquid ejection heads, respectively; a holder which holds the wipers; and a movement mechanism which moves the holder in a direction perpendicular to the one direction so that the wipers move in the perpendicular direction while abutting the ejection faces, respectively. The holder is displaceable in the one direction relative to a support which supports the holder, and the holder has an intruder which intrudes into a gap between two liquid ejection heads adjacent to each other when the holder is moved by the movement mechanism in the perpendicular direction.

According to the liquid ejection device of the present invention, the holder is moved by the movement mechanism in the perpendicular direction with the intruder intruding the gap between two adjacent liquid ejection heads. In this movement, even if the holder is forced to move in a direction deviating from the perpendicular direction, or even if the intruder is subjected to a force in the one direction from a liquid ejection head due to contact with the liquid ejection head, the holder moves in the perpendicular direction along the gap because the intruder intrudes into the gap between two liquid ejection heads and the holder is displaceable in the one direction relative to the support. Therefore, the holder is unable to move in a direction deviating from the perpendicular direction. This structure enables the wipers to move while ensuring that the wipers entirely abutting the respective ejection faces, and to ensure wiping of the ejection faces while maintaining the positions of the wipers in relation to the ejection faces.

In another aspect, the liquid ejection device of the present invention includes: a conveyance mechanism which conveys a recording medium in one direction; a plurality of liquid ejection heads each having an ejection face which has a plurality of ejection openings for ejecting liquid and faces the conveyance mechanism, the liquid ejection heads being arranged into two rows in such a manner that, in each row, two or more liquid ejection heads are arranged along the one direction, and that, when viewed from a direction perpendicular to the one direction and parallel to in-plane directions of the ejection faces, each liquid ejection head in one row does not overlap each liquid ejection head in the other row; a plurality of filler plates each of which is positioned adjacent to, in the one direction, at least one of the liquid ejection heads in a same row so as to overlap one of the liquid ejection heads in the other row, when viewed from the perpendicular direction; a plurality of wipers which wipe the ejection faces of the liquid ejection heads, respectively; a holder which holds the wipers; and a movement mechanism which moves the holder in the perpendicular direction so that the wipers move in the perpendicular direction while abutting the ejection faces, respectively. The holder is displaceable in the one direction relative to the support which supports the holder, and the holder has an intruder which intrudes into a gap between a liquid ejection head and a filler plate adjacent to each other when the holder is moved by the movement mechanism in the perpendicular direction.

According to the liquid ejection device of the present invention, the holder is moved by the movement mechanism in the perpendicular direction with the intruder intruding the gap between a liquid ejection head and a filler plate. In this movement, even if the holder is forced to move in a direction deviating from the perpendicular direction, or even if the intruder is subjected to a force in the one direction from the liquid ejection head or the filler plate due to contact with the liquid ejection head or the filler plate, the holder moves along the gap because the intruder intrudes into the gap between the liquid ejection head and the filler plate. Therefore, the holder does not move in a direction deviating from the perpendicular direction. This structure enables the wipers to move while ensuring that the wipers entirely abutting the respective ejection faces, and to ensure wiping of the ejection faces while maintaining the positions of the wipers in relation to the ejection faces.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

First Embodiment

The following describes a preferred first embodiment of the present invention, with reference to attached drawings. This embodiment deals with an application of the present invention to an inkjet printer which records text, images, or the like on a sheet by ejecting ink thereon.

Figure 1:
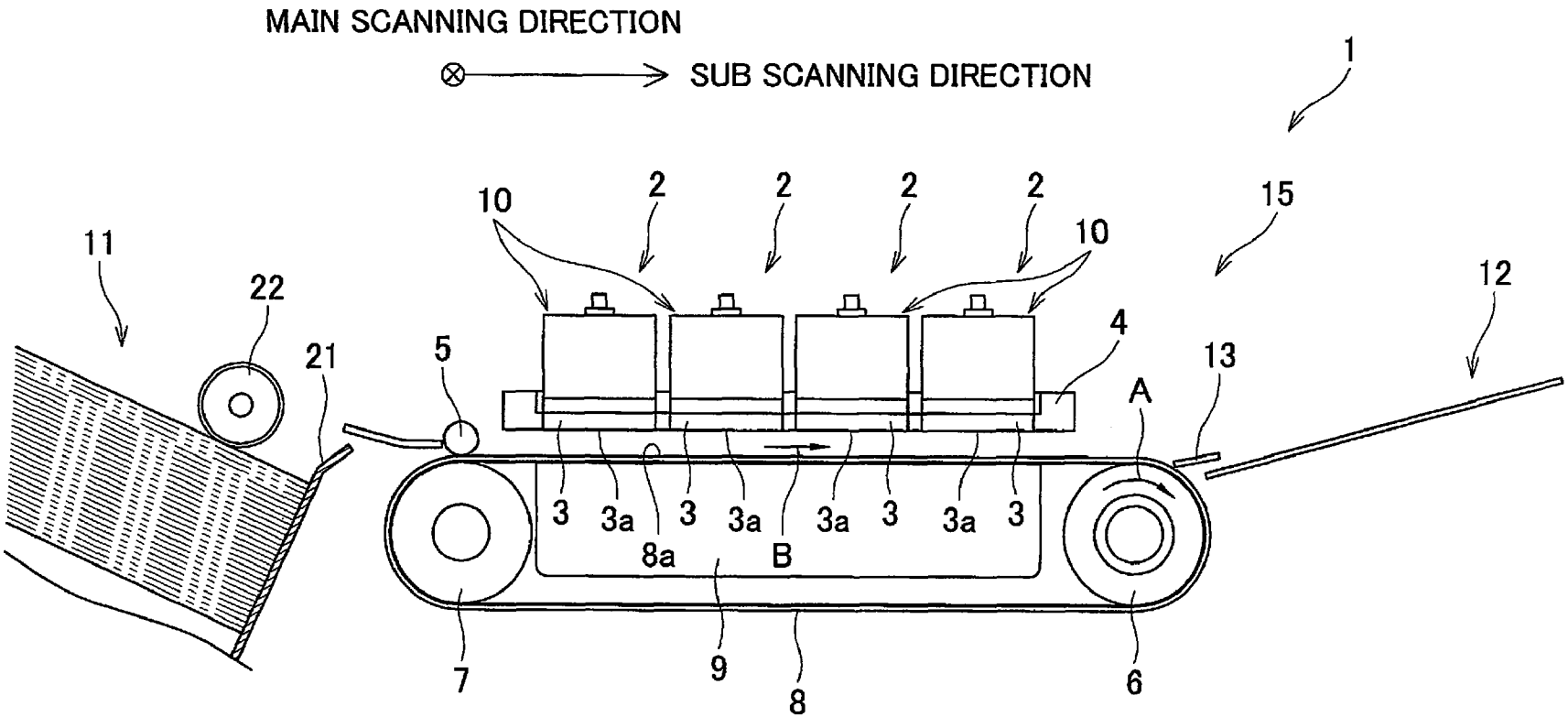
FIG. 1 is a schematic side view of an inkjet printer according to a first embodiment of the present invention.

As shown in FIG. 1, an inkjet printer 1, which is a liquid ejection device, is a color inkjet printer having four inkjet heads 2 which eject ink of magenta, cyan, yellow, and black, respectively. The inkjet printer 1 is provided with a sheet feeding mechanism 11 and a sheet discharger 12, at the left and right in FIG. 1, respectively.

The inkjet printer 1 includes therein a sheet conveyance path for conveying a sheet, which is a recording medium, from the sheet feeding mechanism 11 toward the sheet discharger 12. The sheet feeding mechanism 11 is provided with a pickup roller 22. Driven by a not-shown pickup motor, the pickup roller 22 rotates to pick up a top-most sheet of a stack in a sheet tray 21 and then sends the sheet from the left to the right in FIG. 1. In the sheet conveyance path, between the sheet feeding mechanism 11 and the sheet discharger 12, there is disposed a sheet conveyance mechanism 15 which conveys a sheet in a sub scanning direction which corresponds to a conveyance direction B. The sheet conveyance mechanism 15 has: two belt rollers 6 and 7; and an endless conveyor belt 8 looped around the rollers 6 and 7.

An external surface 8*a* of the conveyor belt 8 has been treated with silicone to achieve adhesiveness. Immediately downstream of the sheet feeding mechanism 11, a pressing roller 5 is disposed so as to face the belt roller 7 with the conveyor belt 8 being interposed therebetween. The pressing roller 5 presses down a sheet sent out from the sheet feeding mechanism 11 onto the external surface 8*a* of the conveyor belt 8. Thus, the sheet pressed onto the external surface 8*a* is conveyed in the conveyance direction B, while being held by adhesion of the external surface 8*a*. During this operation, the belt roller 6 located downstream in the sheet conveyance direction is driven by a not-shown conveyance motor, and rotated clockwise, in a direction of arrow A in FIG. 1.

In the sheet conveyance path, a peeling plate 13 is provided immediately downstream of the conveyor belt 8. The peeling plate 13 is configured to peel a sheet held by the external surface 8*a* of the conveyor belt 8 from the external surface 8*a*, and send the sheet toward the sheet discharger 12 located at the right in the figure.

In a space looped by the conveyor belt 8 disposed is a platen 9 having a nearly rectangular-parallelepiped shape. The platen 9 is positioned so as to face the four inkjet heads 2. More specifically, the platen 9 is positioned so as to contact the under surface of a part of the conveyor belt 8 above the platen 9, and support the conveyor belt 8 from the inner periphery of the conveyor belt 8. As shown in FIG. 1, the presence of the platen 9 forms a predetermined space between the upper surface of the conveyor belt 8 and the under surface of the inkjet heads 2.

Figure 2:
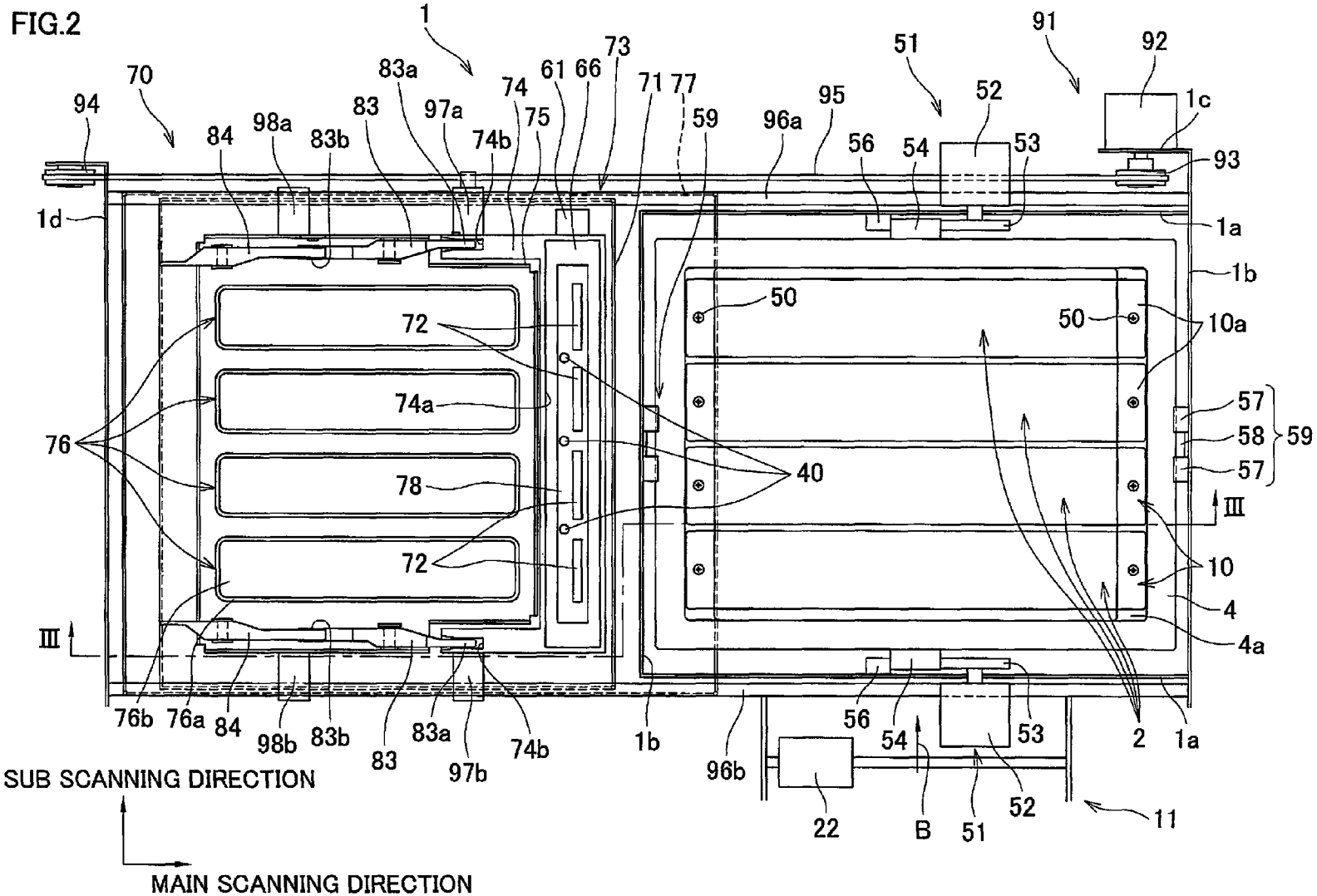
FIG. 2 is a partial plan view of the inkjet printer.
Figure 3:
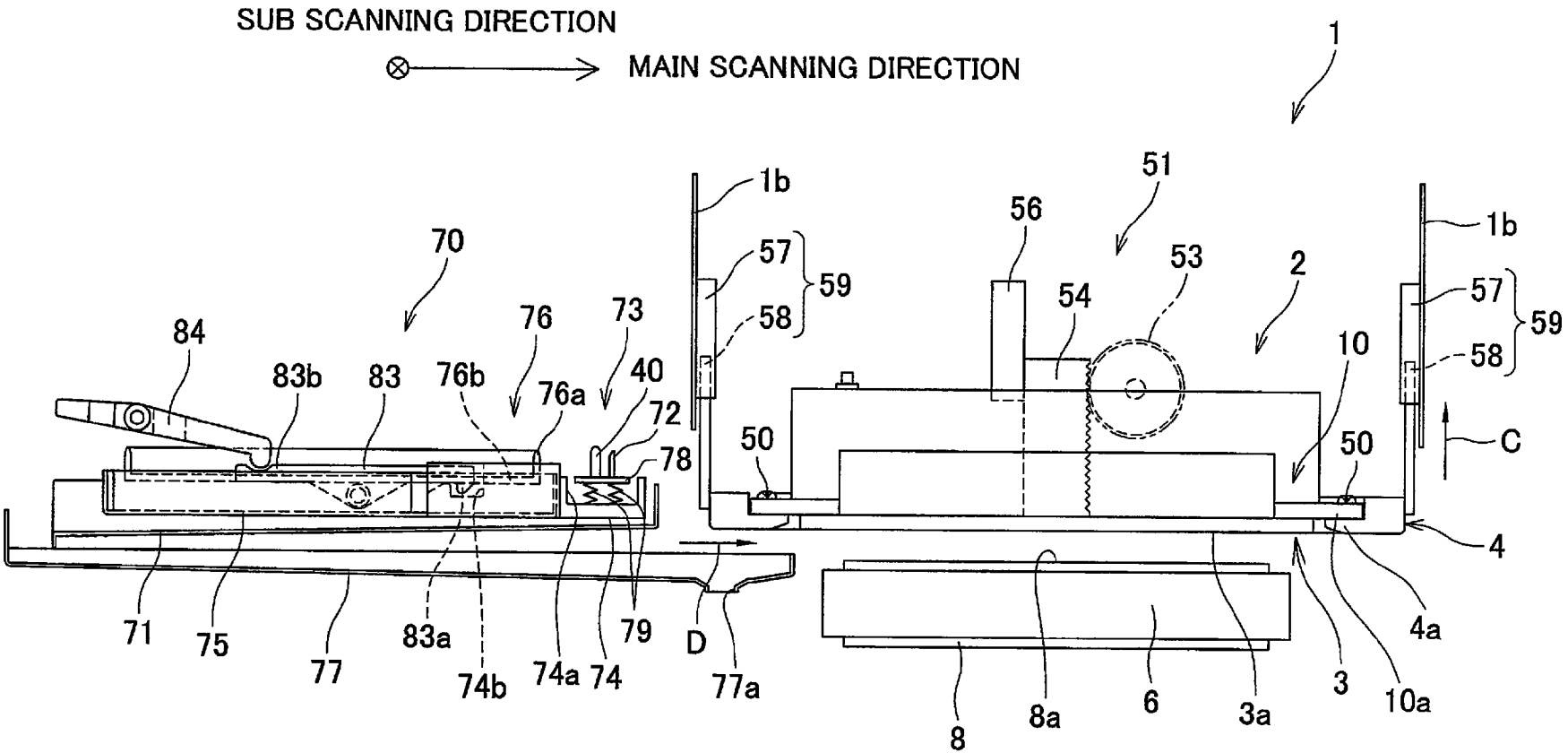
FIG. 3 is a sectional view taken along line III-III in FIG. 2.

As shown in FIG. 2, each of the four inkjet heads 2 extends in a main scanning direction, that is, a direction perpendicular to the sub scanning direction and a direction perpendicular to the paper face of FIG. 1. The inkjet heads 2 are arranged in the sub scanning direction which corresponds to the conveyance direction B. In other words, the inkjet printer 1 is a line-type printer having ejection regions each extending in the main scanning direction. As shown in FIGS. 1 and 3, each inkjet head 2 has, at its lower end, a head main body 3. The head main body 3, which will be detailed later, is formed of a passage unit 30 and an actuator 41 attached together, and has a rectangular-parallelepiped shape with its length in the main scanning direction. In the passage unit 30, a plurality of individual ink passages 45 including a pressure chamber 42 are formed, and the actuator 41 applies pressure to the ink in the pressure chamber 42 (see FIG. 4). In addition, on the under surface of each head main body 3, that is, the ejection face 3*a*, a large number of small-diameter ejection openings 3*b* are formed in arrays (see FIGS. 4 and 5). These small-diameter ejection openings 3*b* are one ends of later-described nozzles 46, respectively.

As shown in FIGS. 1 and 3, on the upper surface of each head main body 3, a reservoir unit 10 is fixed which temporarily reserves ink therein. Each reservoir unit 10 has a greater length in the main scanning direction than that of each head main body 3, and each reservoir unit 10 extends beyond the longitudinal ends of an associated head main body 3. Each reservoir unit 10 is fixed, at the extended portions thereof, to a frame 4 having a rectangular opening so that the ejection faces 3*a* are exposed through the opening, downwardly. To be more specific, a pair of flanges 4*a* are respectively projected inwardly from opposing edges of the frame 4, which flanges supports each reservoir unit 10 from the bottom thereof. The longitudinal ends of each reservoir unit 10 are fixed to the flanges 4*a* with screws 50, respectively. Each ejection face 3*a* is nearly level with the under surface of the frame 4.

The head main bodies 3 are disposed in such a manner that: the ejection faces 3*a* are facing and parallel to the portion of the conveyor belt 8 which is supported by the platen 9; and a small space is created between the ejection faces 3*a* and the conveyor belt 8. That space constitutes a part of the sheet conveyance path. When a sheet conveyed while being held on the external surface 8*a* of the conveyor belt 8 passes immediately under the four head main bodies 3 sequentially, different colors of ink are respectively ejected onto the upper surface, i.e., a print surface, of the sheet, thereby producing a desired color image.

As shown in FIGS. 2 and 3, the frame 4 is supported by a pair of lifting and lowering mechanisms 51 provided to the printer 1 so that the frame 4 is movable vertically, i.e., in a direction perpendicular to the paper face of FIG. 2. The pair of lifting and lowering mechanisms 51 are disposed so as to sandwich the four inkjet heads 2 in the sub scanning direction. Each of the lifting and lowering mechanisms 51 includes: a head motor 52 serving as a drive source for moving the frame 4 vertically; a pinion gear 53 fixed to a shaft of the head motor 52; a rack gear 54 meshing with the pinion gear 53; and a guide 56 disposed so that the rack gear 54 is interposed between the guide 56 and the pinion gear 53.

The head motors 52 included in the lifting and lowering mechanisms 51 are fixed to a pair of main body frames 1*a* of the inkjet printer 1, respectively. The pair of main body frames 1*a* are disposed so as to face each other in the sub scanning direction. Each rack gear 54 extends vertically, and its lower end is fixed to a side face of the frame 4. A side face of the each rack gear 54, opposite to the side face facing an associated pinion gear 53, slidably contacts an associated guide 56. The guides 56 are respectively fixed to the main body frames 1*a*.

When the two head motors 52, in sync with each other, rotate the respective pinion gears 53 in a forward or a reverse direction, the rack gears 54 are moved upward or downward. Along with the movement of the rack gears 54, the frame 4 is vertically lifted or lowered, together with the four inkjet heads 2.

The frame 4 has a pair of guide units 59 respectively mounted on both side edges of the frame 4 each extending in the sub scanning direction. Each of the guide units 59 includes: a rod 58, and a pair of guides 57 which sandwich the rod 58 therebetween. As shown in FIG. 3, the pairs of guides 57 extend vertically and are fixed to a pair of main body frames 1*b* of the inkjet printer 1, respectively. The pair of main body frames 1*b* are disposed so as to face each other in the main scanning direction. The rods 58 extend vertically like the guides 57, and are fixed to the side faces of the above-mentioned side edges of the frame 4, the side faces facing the main body frames 1*b*, respectively. Each rod 58 slidably contacts each of an associated pair of guides 57.

The guide units 59 prevents the ejection faces 3*a* of the inkjet heads 2 from being oblique relative to the portion of the conveyor belt 8 which is supported by the platen 9 when the frame 4 is vertically lifted or lowered by the lifting and lowering mechanisms 51. In other words, even if the frame 4 and the inkjet heads 2 are vertically lifted or lowered by the lifting and lowering mechanisms 51, the ejection faces 3*a* are always parallel to the upper surface of the platen 9. As a result, this improves landing accuracy of ink droplets onto a sheet during printing operation.

Usually, the frame 4 is in a printing position, as shown in FIG. 3, as a result of movement by the lifting and lowering mechanisms 51 in a direction opposite to a direction of arrow C in FIG. 3. The printing position is a position in which the four inkjet heads 2 eject ink to a sheet in order to perform printing on the sheet. Only at a time of maintenance operation of the inkjet heads 2 (e.g., purging, in which inkjet heads 2 are forced to eject ink; wiping off ink adhered to the ejection faces 3*a*; and capping the ejection faces 3*a*), the frame 4 is moved by the lifting and lowering mechanisms 51 in the direction of arrow C in FIG. 3, and the four inkjet heads 2 are located in a head maintenance position, which is above the printing position.

Next, a maintenance unit 70 will be described, which performs maintenance on the inkjet heads 2. As shown in FIGS. 2 and 3, the maintenance unit 70 is disposed at the left of the inkjet heads 2. The maintenance unit 70 has two horizontally movable trays 71 and 75. Out of these trays, the tray 71 has a squarish open-top box-like shape, and contains the tray 75 therein. The tray 71 and the tray 75 can be connected to/disconnected from each other in a switchable manner, i.e., they are connected to each other by the engagement of later-mentioned recesses 74*b* with projections 83*a*, and disconnected from each other by the disengagement thereof.

Before the maintenance unit 70 horizontally moves to the right, the frame 4 moves upward (in the direction of arrow C in FIG. 3) in advance, to the head maintenance position, so that a space for the maintenance unit 70 is reserved between the four ejection faces 3*a* and the conveyor belt 8. Then, the maintenance unit 70 horizontally moves in a direction of arrow D in FIG. 3. The tray 71 is open at a side end extending in the sub scanning direction, which end is farther from the inkjet heads 2 ("farther end"). Therefore, only the tray 71 horizontally moves to the right, with the contained tray 75 left behind, when the recess 74*b* is disengaged from the projection 83*a*, for example, at a time of a purge process.

Immediately below the maintenance unit 70, a waste ink receiving tray 77 is disposed. The waste ink receiving tray 77 has enough dimensions to contain the tray 71 in a plan view, and is structured so that, even if the tray 71 is at its rightmost position in FIG. 2, the waste ink receiving tray 77 overlaps at least the farther end of the tray 71. At an end of the waste ink receiving tray 77 closer to the inkjet heads 2, an ink outlet hole 77*a* is formed. Through the ink outlet hole 77*a*, ink flowing into the waste ink receiving tray 77 is sent to a not-shown waste ink reservoir.

In the tray 71, there are disposed: four wipers 72; three protrusions 40 (intruder); and the tray 75; in this order in a direction departing from the inkjet heads 2. In the tray 75 are four caps 76 each having a rectangular plane shape. These four caps 76 correspond to the inkjet heads 2, respectively, and are arranged in the sub scanning direction at the same intervals as the inkjet heads 2 so that the longitudinal direction of each cap 76 is parallel to the longitudinal direction of each inkjet head 2.

Each of the caps 76 is constituted of: a plate member 76*b* having a rectangular plane shape of almost same size as that of each ejection face 3*a*; and an annular ridge 76*a* projected upwardly from the circumferential edge of the plate member 76*b*. The annular ridge 76*a* is formed of an elastic material such as rubber, and has a size and shape matched to the circumferential edge of an associated ejection face 3*a*. Each cap 76 creates a hermetically sealed space when the annular ridge 76*a* abuts the circumferential edge of an associated ejection face 3*a*. Thus, the caps 76 are capable of covering the ejection faces 3*a* respectively. Further, each cap 76 is supported onto the lower surface of the tray 75 and urged upward, by not-shown two springs.

In addition to the four wipers 72 and the three protrusions 40, a mounting member 74 (support) is fixed on the tray 71 in which member a retaining plate 78 (holder) and springs 79 disposed. The mounting member 74 has a U-shape in a plan view. The mounting member 74 has a groove 74*a* extending in the sub scanning direction, which is formed on the upper surface of a portion the mounting member 74 extending in the sub scanning direction. In the groove 74*a*, the retaining plate 78, the springs 79, the four wipers 72, and the three protrusions 40 are disposed. In the meantime, recesses 74*b* are respectively formed on the upper surfaces of two portions of the mounting member 74, which portions extend in the main scanning direction.

The wipers 72 are made of an elastic material such as rubber. Each wiper 72 is designed to have the same width as that of each inkjet head 2 in the sub scanning direction. The four wipers 72 are fixed on the retaining plate 78 along the sub scanning direction so as to respectively overlap the four inkjet heads 2, when viewed from the main scanning direction.

Each of the protrusions 40 has a round leading end, and is provided in a space between two wipers 72 adjacent to each other. In addition, the three protrusions 40 are fixed on the retaining plate 78 along the sub scanning direction so that, when viewed from the main scanning direction, each of the protrusions overlaps a gap between two inkjet heads 2 adjacent to each other. Note that the position relation between the protrusions 40 and the wipers 72 is same as the position relation between the gaps between the inkjet heads 2 and the regions to be wiped by the wipers 72 ("wiping-target regions").

The retaining plate 78 has a rectangular-parallelepiped shape with the length longer than the total length of the four inkjet heads 2 in the sub scanning direction. The retaining plate 78 is urged upward by the springs 79 which are elastic members, while being supported by the springs 79 onto the mounting member 74. In addition, the presence of the springs 79 allows the retaining plate 78 to be displaced in the sub scanning direction.

The recesses 74*b* and associated hook members 83 are respectively provided near both side edges, extending in the main scanning direction, of the trays 71 and 75. Each hook member 83 extends in the main scanning direction, and is rotatable about a middle part thereof. Each hook member 83 has a projection 83*a* formed at an end thereof closer to the inkjet heads 2. Clockwise rotation of the hook members 83 in FIG. 3 causes the projections 83*a* to be engaged with the respective recesses 74*b*. Above the maintenance unit 70, abutting members 84 are disposed so as to be associated with the two hook members 83, respectively. The tray 71 can be connected to/disconnected from the tray 75 in a switchable manner, depending on the engagement/disengagement of the recesses 74*b* with/from the projections 83*a*.

The abutting members 84 are rotatably supported. As each abutting member 84 rotates clockwise in FIG. 3, one end of each abutting member 84 abuts an end 83*b* of an associated hook member 83. Further clockwise rotation of the abutting members 84 causes the associated hook members 83 to rotate counterclockwise, thereby disengaging the projections 83*a* from the respective recesses 74*b*. On the other hand, when counterclockwise rotation of the abutting members 84 causes the abutting members 84 to depart from the ends 83*b*, the projections 83*a* are engaged with the recesses 74*b* respectively because of the self weights of the hook members 83.

As shown in FIGS. 2 and 3, the maintenance unit 70 stands at a "withdrawal position" in which the maintenance unit 70 does not face the inkjet heads 2, when maintenance of the inkjet heads 2 is not performed. Meanwhile, at a time of performing maintenance, the maintenance unit 70 horizontally moves, from the withdrawal position, to a "maintenance position" in which the maintenance unit 70 faces the ejection faces 3*a* of the inkjet heads 2. At this time, since the frame 4 is in the head maintenance position, the leading ends of the wipers 72 and the caps 76 do not contact the ejection faces 3*a*.

Note that, at a time of a purge process during maintenance, only the tray 71 moves, without the tray 75, from the withdrawal position to the maintenance position to receive discharged ink. When the ejection faces 3*a* are covered with the caps 76, the tray 71 is connected to the tray 75 by the engagement of the recesses 74*b* with the projections 83*a*, and the maintenance unit 70 moves to the position in which the caps 76 respectively face the ejection faces 3*a*.

As shown in FIG. 2, the trays 71 and 75 are slidably supported by a pair of guide shafts 96*a* and 96*b* each extending in the main scanning direction. To the tray 71, two bearing members 97*a* and 97*b* are provided. The bearing members 97*a* and 97*b* are projected from the both side surfaces of the mounting member 74 each extending in the main scanning direction. To the tray 75, two bearing members 98*a* and 98*b* are provided. The bearing members 98*a* and 98*b* are projected from the both side surfaces of the tray 75 each extending in the main scanning direction. In addition, each of the guide shafts 96*a* and 96*b* is fixed, at both ends thereof, to main body frames 1*b* and 1*d*, respectively, and the guide shafts 96*a* and 96*b* are disposed parallel to each other between the frames 1*b* and 1*d*.

Now, the following details a horizontal movement mechanism 91 which moves the trays 71 and 75 horizontally (in the direction of arrow D), along the guide shafts 96*a* and 96*b*. As shown in FIG. 2, the horizontal movement mechanism 91 has a tray motor 92, a motor pulley 93, an idle pulley 94, a timing belt 95, the guide shafts 96*a* and 96*b*, and the like.

The tray motor 92 is fixed to a mounting part 1*c* formed at one end of the main body frame 1*b* extending in the sub scanning direction. The motor pulley 93 is connected to the tray motor 92, and the motor pulley 93 rotates, driven by the tray motor 92. The idle pulley 94 is rotatably supported by the main body frame 1*d*, at the leftmost in FIG. 2. The timing belt 95 is disposed parallel to the guide shaft 96*a*, and looped around the motor pulley 93 and the idle pulley 94. Furthermore, the timing belt 95 is connected to the bearing member 97*a* provided to the mounting member 74.

In this structure, driving of the tray motor 92 allows the motor pulley 93 to rotate in a forward or a reverse direction, which causes the timing belt 95 to run. As the timing belt 95 runs, the tray 71 connected to the timing belt 95 via the bearing member 97*a* moves horizontally. This moves the three protrusions 40 and the four wipers 72 in the tray 71 and the caps 76 in the tray 75, when the recesses 74*b* of the mounting member 74 are respectively engaged with the projections 83*a*. On the other hand, when the projections 83*a* are not engaged with the recesses 74*b* respectively, only the three protrusions 40 and the four wipers 72 in the tray 71 are moved.

Figure 4:
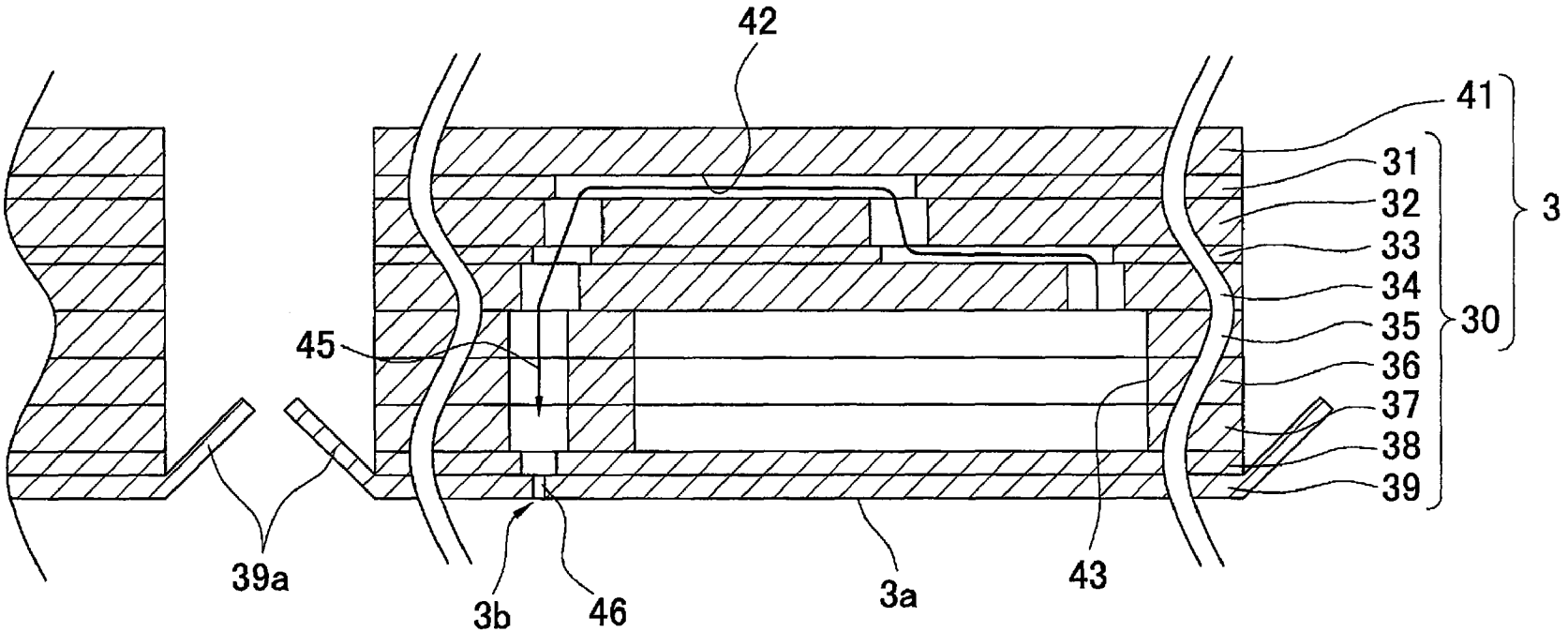
FIG. 4 is a partial sectional view of a head main body.

Next, the structure of the head main bodies 3 will be described with reference to FIGS. 4 and 5. As shown in FIG. 4, each head main body 3 has: a passage unit 30 having a rectangular shape with its length in the main scanning direction; and an actuator unit 41 fixed on the upper surface of the passage unit 30. The passage unit 30 has a layered structure sequentially including, from the top, a cavity plate 31, a base plate 32, an aperture plate 33, a supply plate 34, manifold plates 35, 36, and 37, a cover plate 38, and a nozzle plate 39. The nozzle plate 39 is a metal plate having a large number of nozzles 46 formed thereon.

These nine metal plates 31 to 39 are positioned relative to one another and stacked so that a large number of individual ink passages 45 are formed in the layered structure. Ink supplied through a not-shown ink supply opening flows into each individual ink passage 45 via a sub manifold channel 43. In each individual ink passage 45, the ink flowing from the sub manifold channel 43 passes through a pressure chamber 42, then reaches a nozzle 46.

Figure 5:
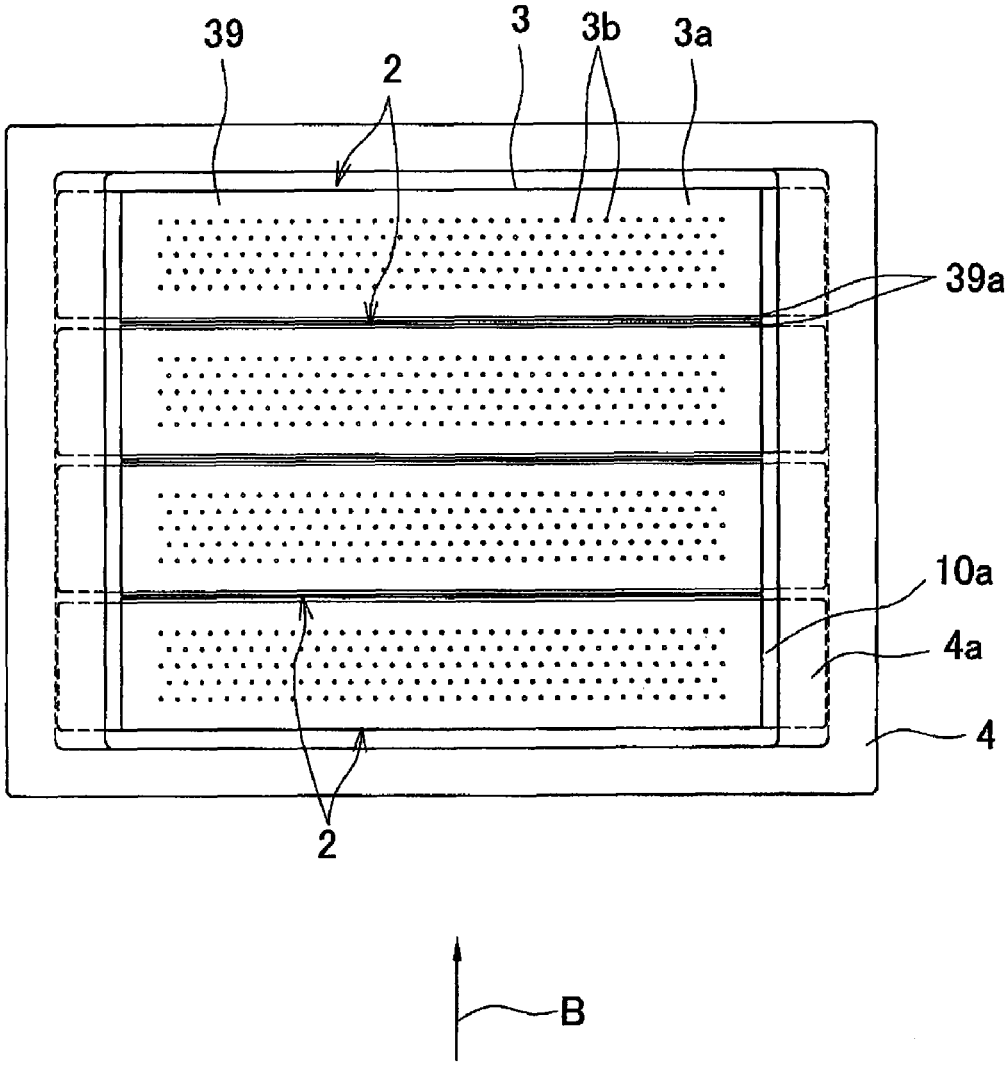
FIG. 5 is a plan view of inkjet heads and a frame, viewed from below.

In this embodiment, as shown in FIGS. 4 and 5, each nozzle plate 39 has a greater width in the sub scanning direction compared to the plates other than the nozzle plate 39, i.e., the plates 31 to 38. In addition, each end of the nozzle plate 39 in the sub scanning direction forms an inclined plane 39*a* (guide member) which is inclined in a direction departing from the sheet conveyance mechanism 15. The both inclined planes 39*a* have the same inclined angle to the sheet conveyance mechanism 15. Note that each inclined plane 39*a* is bent at an angle such that an inclined plane 39*a* of one nozzle plate 39 does not overlap an inclined plane 39*a* of another nozzle plate 39 adjacent to the one nozzle plate 39.

Next, the operation of the maintenance unit 70 will be hereinafter described with reference to FIGS. 6 to 8. The frame 4 is moved upward by the lifting and lowering mechanisms 51 when performing a purge process for recovering the inkjet heads 2 having a problem such as poor ink ejection. At this time, the two head motors 52 are driven in sync with each other to rotate the respective pinion gears 53 in the forward direction (clockwise in FIG. 3). Then, the rotation of the pinion gears 53 moves the respective rack gears 54 upward. The frame 4 fixed to the rack gears 54 is also moved upward, with the four inkjet heads 2. Then, the rotation of the head motors 52 is stopped when the frame 4 and the inkjet heads 2 reach the head maintenance position.

In this manner, a space capable of accommodating the maintenance unit 70 is created between the ejection faces 3*a* and the conveyor belt 8. Thus, the ejection faces 3*a* of the inkjet heads 2 and the under surface of the frame 4, while being in the head maintenance position, do not contact the leading ends of the wipers 72 and annular ridges 76*a*, respectively, when the maintenance unit 70 is moved to the maintenance position.

Figure 6A:
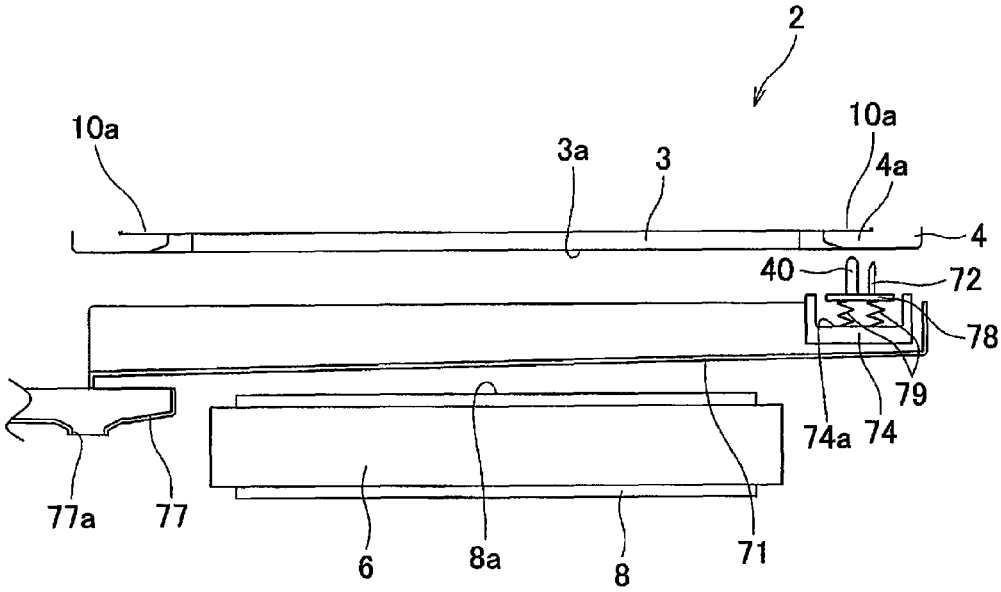
FIG. 6A is a side view illustrating a state where the inkjet heads has moved from a print position to a head maintenance position and a tray of a maintenance unit has moved to a maintenance position.

Then, abutting of the abutting members 84 against the respective ends 83*b* of the hook members 83 causes the projections 83*a* to be separated from the recesses 74*b*, with the result that the projections 83*a* are disengaged from the recesses 74*b*, respectively. That is, the tray 71 is disconnected from the tray 75. Then, the tray motor 92 of the horizontal movement mechanism 91 is driven to run the timing belt 95 so that the tray 71 having been disconnected from the tray 75 is moved to the maintenance position. The driving of the tray motor 92 is stopped after the tray 71 reaches the maintenance position as shown in FIG. 6A.

Figure 7A:
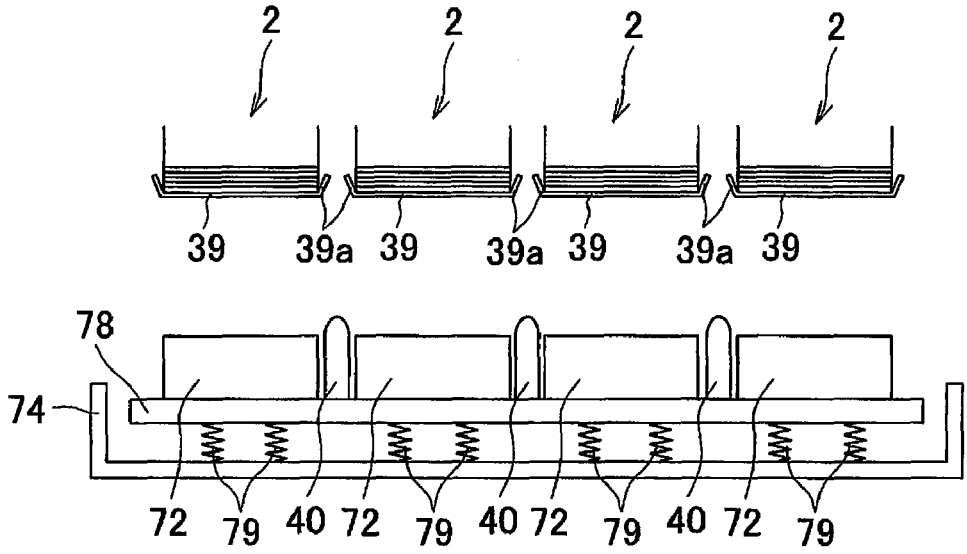
FIG. 7A is a schematic front view, viewed from a position along a main scanning direction, which illustrates a state where the inkjet heads are in the head maintenance position and the tray is in the maintenance position.

At this time, as shown in FIG. 7A, the four wipers 72 are in the position where the four wipers 72 respectively overlap the four inkjet heads 2 when viewed from the vertical direction. Meanwhile, the three protrusions 40 are in the position where the three protrusions 40 respectively overlap three gaps when viewed from the vertical direction, each of which gaps is formed between two inkjet heads 2 adjacent to each other.

Next, a purge process is performed, which ejects ink from the nozzles 3*b* of the inkjet heads 2 into the tray 71, by driving not-shown pumps to force ink reserved in not-shown ink tanks into the inkjet heads 2. This purge process removes clogging from the nozzles 3*b* having a problem of poor ink ejection, or thickened ink from the nozzles 3*b*. The ink ejected to the tray 71 travels along the lower surface of the tray 71 to the left in FIG. 6, and then flows into the waste ink receiving tray 77. Then, the purged ink is discharged from the ink outlet hole 77*a* of the waste ink receiving tray 77. However, a portion of the ink remains in a form of ink droplets, on the ejection faces 3*a*.

Next, the inkjet heads 2 are moved downward by the lifting and lowering mechanisms 51. First, the inclined planes 39*a* of the nozzle plates 39 contact the leading ends of the protrusions 40, respectively. Further downward movement of the inkjet heads 2 causes each protrusion 40 intrudes into an associated gap between two inclined planes 39*a* adjacent to each other. At this time, the retaining plate 78 is supported by the springs 79 on the mounting member 74, and therefore the retaining plate 78 is displaceable in the sub scanning direction. In spite of such a simple structure, each protrusion 40 is guided by the inclined planes 39*a* being in contact with, to easily reach its predetermined position between inkjet heads 2. Here, the presence of two inclined planes 39*a* formed in a gap between two adjacent nozzle plates 39 facilitates intrusion of each protrusion 40. In addition, the round shape of the leading end of each protrusion 40 further facilitates intrusion of each protrusion 40 into a gap between two adjacent inclined planes 39*a*.

Figure 6B:
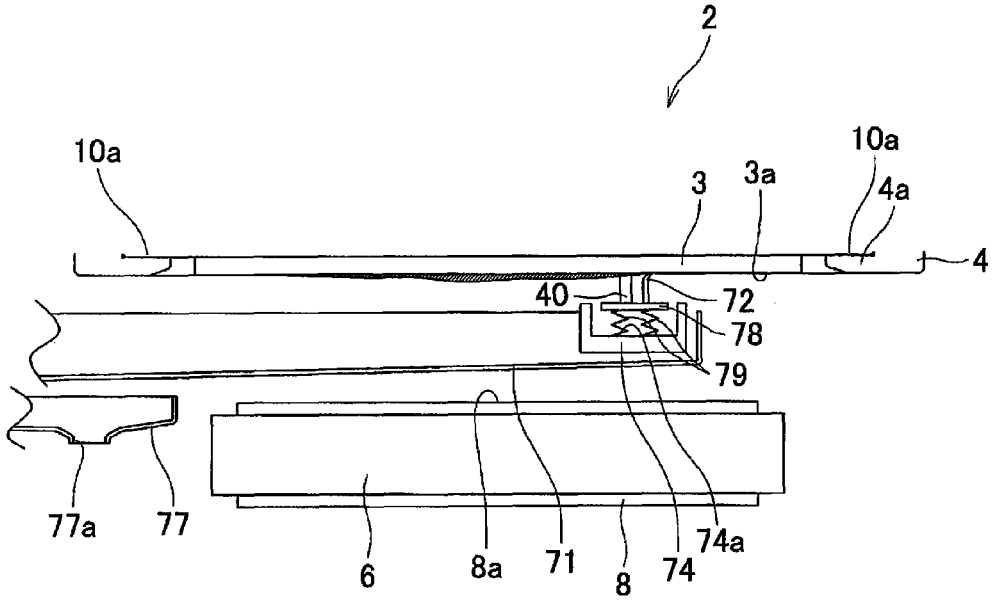
FIG. 6B is a side view illustrating the wipers wiping ink adhered to ejection faces.
Figure 7B:
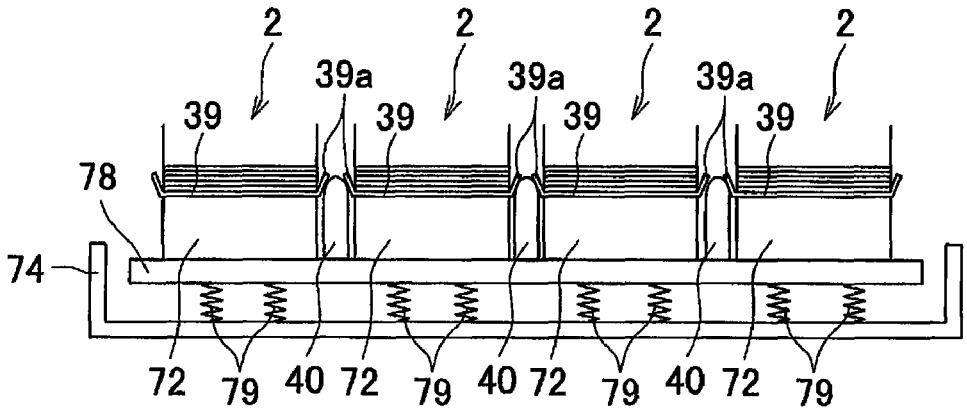
FIG. 7B is a schematic front view, viewed from the position along the main scanning direction, which illustrates the wipers wiping ink adhered to the ejection faces respectively.

As shown in FIG. 7B, the inkjet heads 2 are positioned so that the leading ends of the wipers 72 abut the respective ejection faces 3*a* and the under surface of the frame 4 when the tray 71 is moved to the left (to the withdrawal position) Then, as shown in FIG. 6B, the tray 71 is moved to the left by the horizontal movement mechanism 91. In other words, the tray 71 is moved from the maintenance position to the withdrawal position.

As a result of this operation, the four wipers 72 are moved in a wiping direction from the right to the left in FIG. 6B, and the four wipers 72 respectively wipe the associated four ejection faces 3*a*. During this operation, each protrusion 40 intrudes into a gap between two adjacent inclined planes 39*a*, and therefore the positions of the wiping-target regions of the ejection faces 3*a* are respectively aligned with the positions of the associated wipers 72. In addition, the springs 79 interposed between the retaining plate 78 and the mounting member 74 serve as a cushion member for absorbing a force that may shift the protrusions 40 in the sub scanning direction. Accordingly, the retaining plate 78 is displaceable in the sub scanning direction relative to the mounting member 74. Therefore, even if the tray 71 having the mounting member 74 moves deviating from the main scanning direction, the retaining plate 78 does not move in a direction deviating from the main scanning direction. In this situation, the protrusions 40 slide along the inclined planes 39*a*, which restrains the wipers 72 from moving in the sub scanning direction, and therefore the wipers 72 move in the main scanning direction. In this operation, the upper ends of the four wipers 72 are leveled higher than the under surfaces of the ejection faces 3*a*. Because of this, the wipers 72 respectively contact the four ejection faces 3*a* while being warped, and wipe off ink adhered to the four ejection faces 3*a* due to purging.

Figure 8A:
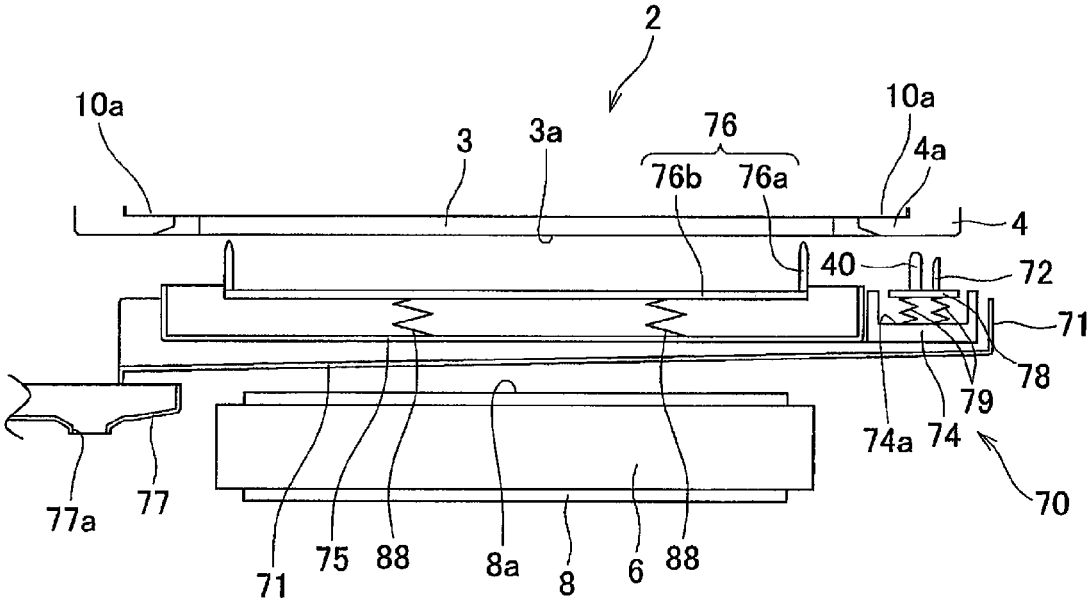
FIG. 8A is a side view illustrating a state the whole maintenance unit has moved to the maintenance position.

The following describes capping process of covering the ejection faces 3*a* with the caps 76 when the printer 1 is in a non-operating status in which operation such as printing on a sheet is not performed for a long time. Similarly to the above, the inkjet heads 2 in this process are moved by the lifting and lowering mechanisms 51 from the print position to the head maintenance position. While the tray 71 is connected to the tray 75 via the hook member 83, the tray 71 and the tray 75 are moved to the maintenance position by the horizontal movement mechanism 91. As shown in FIG. 8A, the caps 76 at this time are positioned so that the plate members 76*b* face the ejection faces 3*a* and the annular ridges 76*a* face the circumferential edges of the ejection faces 3*a*, respectively.

Figure 8B:
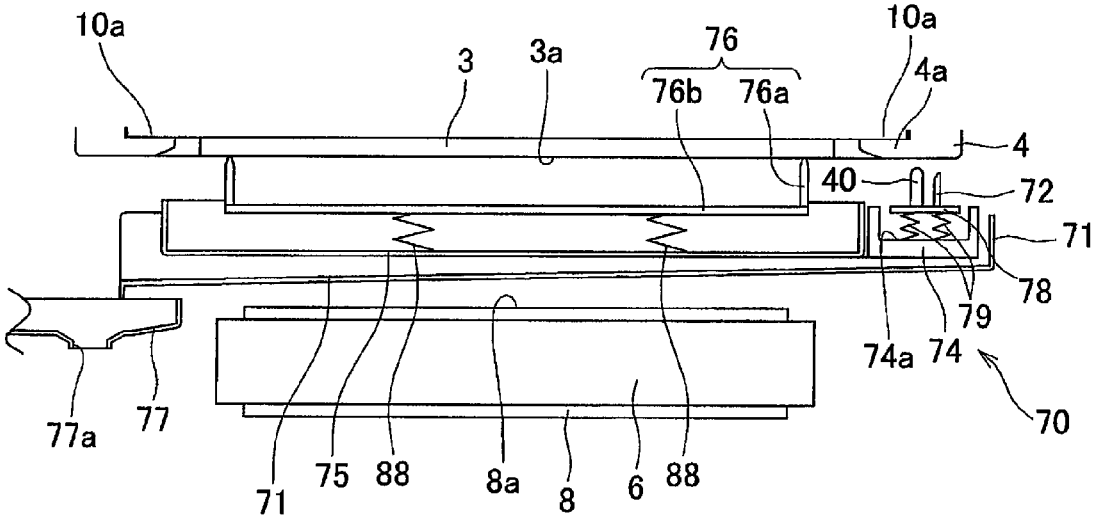
FIG. 8B is a side view illustrating annular ridges of caps abutting ejection faces.

Next, as shown in FIG. 8B, the inkjet heads 2 are moved downward by the lifting and lowering mechanisms 51, so that the leading ends of the annular ridges 76*a* abut the circumferential edges of the ejection faces 3*a*, respectively. Abutting the annular ridges 76*a* and the circumferential edges of the ejection faces 3*a* improves gas-tightness of the hermetically sealed spaces enclosed with the caps 76 and the ejection faces 3*a* respectively, thereby preventing the drying of ink in the nozzles 3*b*.

With the inkjet printer 1 of the first embodiment described above, it is possible to move each wiper 72 while ensuring that the wiper 72 entirely abuts the corresponding ejection face 3*a*, and to surely wipe out ink adhered to the ejection face 3*a* while maintaining the position of the wiper 72 relative to the ejection face 3*a*. In addition, with the low-cost structure simply having inclined planes 39*a* at both ends in the sub scanning direction of each nozzle plate 39, the protrusions 40 are able to be smoothly guided along the main scanning direction. Moreover, movement of the wipers 72 in the sub scanning direction is restrained simply by inserting each protrusion 40 into a gap between two adjacent inkjet heads 2.

Second Embodiment

Figure 9:
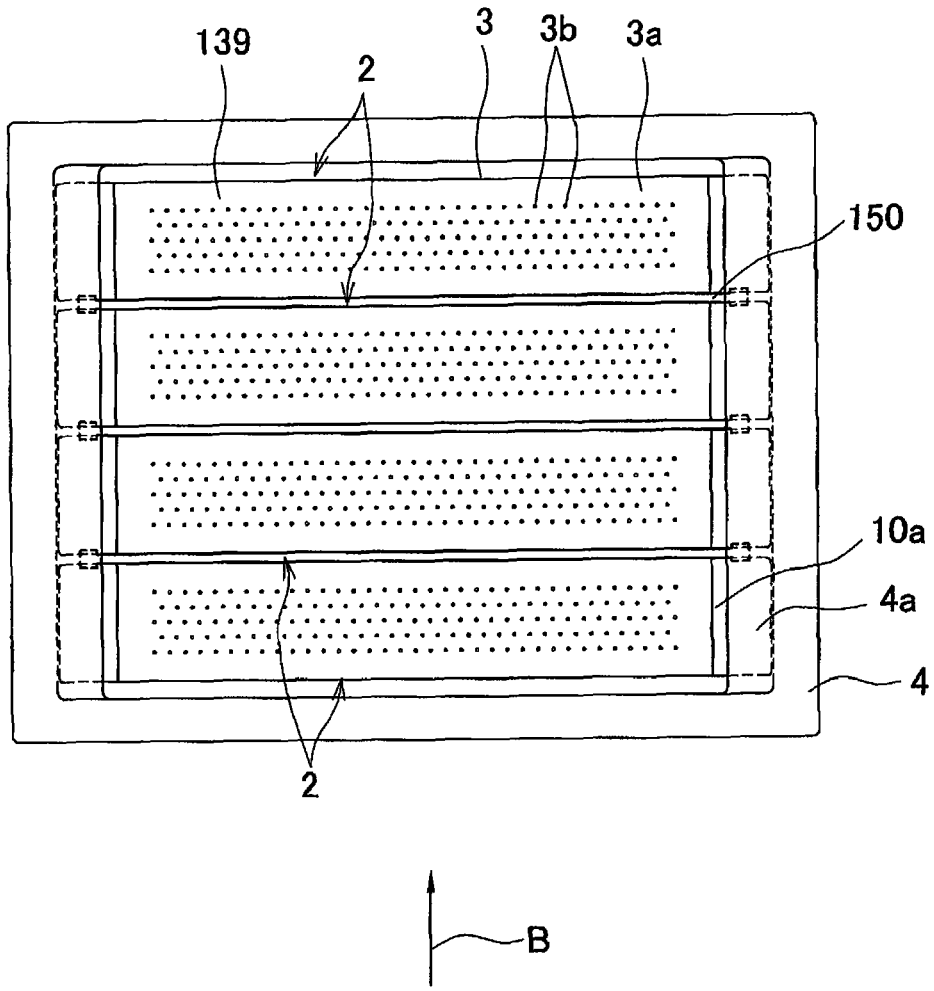
FIG. 9 is a plan view, viewed from below, of inkjet heads and a frame according to a second embodiment of the present invention.
Figure 10:
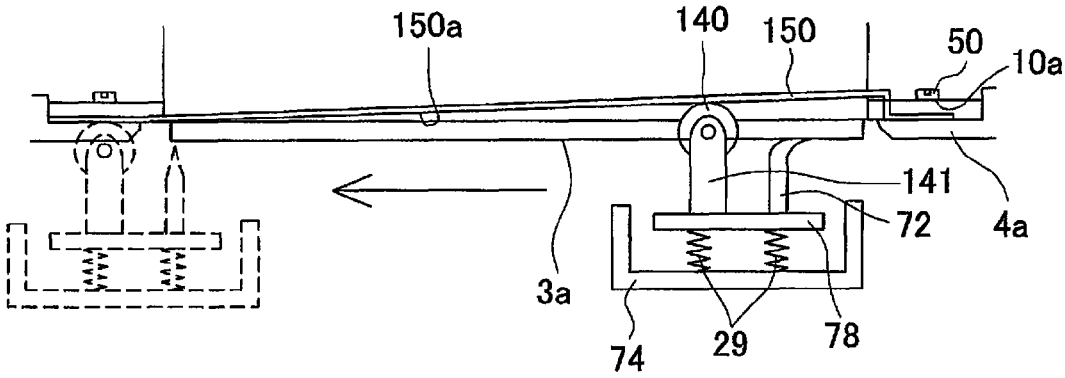
FIG. 10 is a side view illustrating wipers wiping ink adhered to ejection faces in the second embodiment of the present invention.

Next, the following describes an inkjet printer according to a second embodiment with reference to FIGS. 9 to 11. The inkjet printer of the second embodiment has a similar structure to that of the first embodiment, except that guide plates 150 and rollers 140 are provided instead of the inclined planes 39*a* formed on the nozzle plates 39 and the protrusions 40. The same components as in the first embodiment will be given the same reference numerals, and the description thereof will be omitted.

A nozzle plate 139 of the second embodiment does not include the inclined planes 39*a* described in the first embodiment, and each nozzle plate 139 has a same width in the sub scanning direction as those of plates 31 to 38, i.e., plates other than the nozzle plate 139. As shown in FIG. 9, in each gap between two inkjet heads 2 adjacent to each other, there is provided a guide plate 150 with its length in the longitudinal direction of the inkjet heads 2. Note that three guide plates 150 are arranged in the sub scanning direction.

As shown in FIG. 9, the both longitudinal ends of each guide plate 150 are respectively fixed to flanges 4*a* of a frame 4 by thermal welding or the like. As shown in FIG. 10, each guide face 150*a*, which is the under surface of each guide plate 150, gradually slopes down from the right to the left in FIG. 10 so that one longitudinal end thereof closer to a maintenance unit 70 in a withdrawal position is closer to a sheet conveyance mechanism 15 than the other end.

Figure 11A:
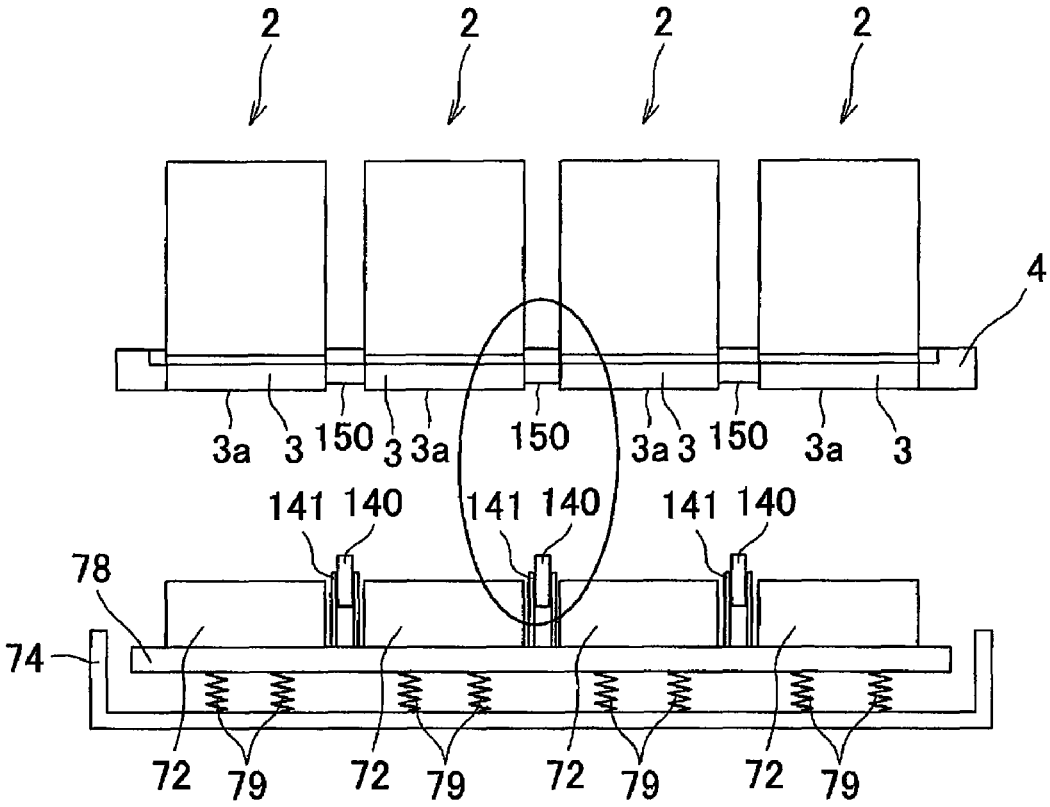
FIG. 11A is a schematic front view, viewed from a position along a main scanning direction, which illustrates a state where of the inkjet heads of the second embodiment are in a head maintenance position and a tray is in a maintenance position.

As shown in FIG. 11A, the three rollers 140 are provided to a retaining plate 78. On the retaining plate 78, support arms 141 are mounted. The rollers 140 are rotatably supported by shafts of the support arms 141, respectively, each of the shafts extending in the sub scanning direction. These support arms 141 are respectively disposed at almost same positions as those of the protrusion 40 of the first embodiment. That is, the three support arms 141 are fixed on the retaining plate 78 along the sub scanning direction so that, in relation to the sub scanning direction, the support arms 141 are respectively in the same positions as the three guide plates 150 each provided in a gap between two inkjet heads 2 adjacent to each other. In other words, each of the three rollers 140 is provided in a space between two wipers 72 adjacent to each other. Note that each of the three rollers 140 is capable of rolling on and moving along the associated guide plate 150.

Figure 11B:
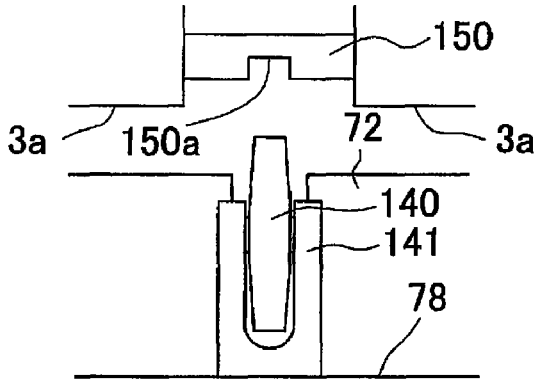
FIG. 11B is an enlarged view of the enclosed region in FIG. 11A.

As shown in FIG. 11B, each guide plate 150 has a guide slot 150*a* extending in the main scanning direction. Each guide slot 150*a* has an adequate width for the edge portion of an associated roller 140 to fit therein when the roller 140 abuts the associated guide plate 150. When the rollers 140 are respectively fitted into (engaged with) the guide slots 150*a*, the inner surfaces of the guide slots 150*a* restrain the rollers 140 from being displaced in the sub scanning direction. At this time, positions of wiping-target regions of ejection faces 3*a* are respectively aligned with the positions of the wipers 72. Note that, the edge portion of each roller 140 has a cross section which is tapered down toward a corresponding guide slot 150*a*, i.e., the thickness of each roller 140 becomes gradually thinner at its circumferential edge. This enables the rollers 140 to smoothly fit into the guide slots 150*a*, respectively.

The following deals with a purge process performed in this embodiment for recovering the inkjet heads 2 having a problem such as poor ink ejection. As in the first embodiment, the frame 4 and the inkjet heads 2 first move to a head maintenance position. Then, the maintenance unit 70 moves to a maintenance position. Then, the inkjet heads 2 are moved downward. Since the presence of springs 79 allows the retaining plate 78 to be displaced in the sub scanning direction relative to a mounting member 74, each of the rollers 140 intrudes into a gap between two adjacent inkjet heads 2 while being displaced in the sub scanning direction relative to the mounting member 74. As a result, the rollers 140 are respectively engaged with the guide plates 150. At this time, the leading ends of the wipers 72 abut the respective ejection faces 3*a* and the under surface of the frame 4.

Then, a tray 71 is moved to the left, that is, from the maintenance position to the withdrawal position. This causes the four wipers 72 to move in a wiping direction which is from the right to the left in FIG. 10. As a result, the four wipers 72 respectively wipe the four ejection faces 3*a* associated therewith. During this operation, each roller 140 intrudes into a gap between two adjacent inkjet heads 2 and is engaged with a corresponding guide plate 150, and the springs 79 allow the retaining plate 78 to be displaced in the sub scanning direction relative to the mounting member 74. Therefore, even if the tray 71 having the mounting member 74 moves deviating from the main scanning direction, the engagement of the rollers 140 with the guide plates 150 ensures that the wipers 72 respectively wipe the wiping-target regions of the ejection faces 3*a*. In this operation, the springs 79 serve as a cushion member for absorbing a force that may shift the retaining plate 78 in the sub scanning direction. Therefore, the retaining plate 78 does not move in a direction deviating from the main scanning direction. In addition, since the upper ends of the four wipers 72 are leveled higher than the under surfaces of the respective ejection faces 3*a*, the wipers 72 respectively contact the four ejection faces 3*a* while being warped, and wipe off ink adhered to the four ejection faces 3*a* due to purging.

Here, each of the guide plates 150 gradually slopes down from the right to the left in FIG. 10 so that one longitudinal end thereof closer to the maintenance unit 70 in the withdrawal position is closer to the sheet conveyance mechanism 15 than the other end. Because of this structure, the closer each roller 140 moves to the withdrawal position, the bigger pressing force is applied from the guide plates 150 toward the sheet conveyance mechanism 15. This pressing force causes the springs 79 to contract downward, and thereby the rollers 140 and the retaining plate 78 become closer to the sheet conveyance mechanism 15. As the retaining plate 78 becomes closer to the sheet conveyance mechanism 15, the wipers 72 also become closer to the sheet conveyance mechanism 15, and therefore the wipers 72 smoothly depart from the ejection faces 3*a* after wiping the ejection face 3*a*. This prevents ink from scattering when the wipers 72 depart from the ejection faces 3*a* after the wiping of the ejection faces 3*a* is finished.

The inkjet printer of the second embodiment described above also brings about advantageous effects that are similar to those of the first embodiment. That is, it is possible to move each wiper 72 while ensuring that the wiper 72 entirely abuts the corresponding ejection face 3*a*, and to surely wipe out ink adhered to the ejection face 3*a* while maintaining the position of the wiper 72 relative to the ejection face 3*a*. In addition, since the rollers 140 can roll and move along the guide plates 150, it is possible to surely move each of the rollers 140 along an associated guide plate 150 provided in a gap between two adjacent inkjet heads 2. This restrains the wipers 72 from moving in the sub scanning direction, and ensures that the wipers 72 are moved in the main scanning direction.

Third Embodiment

Figure 12:
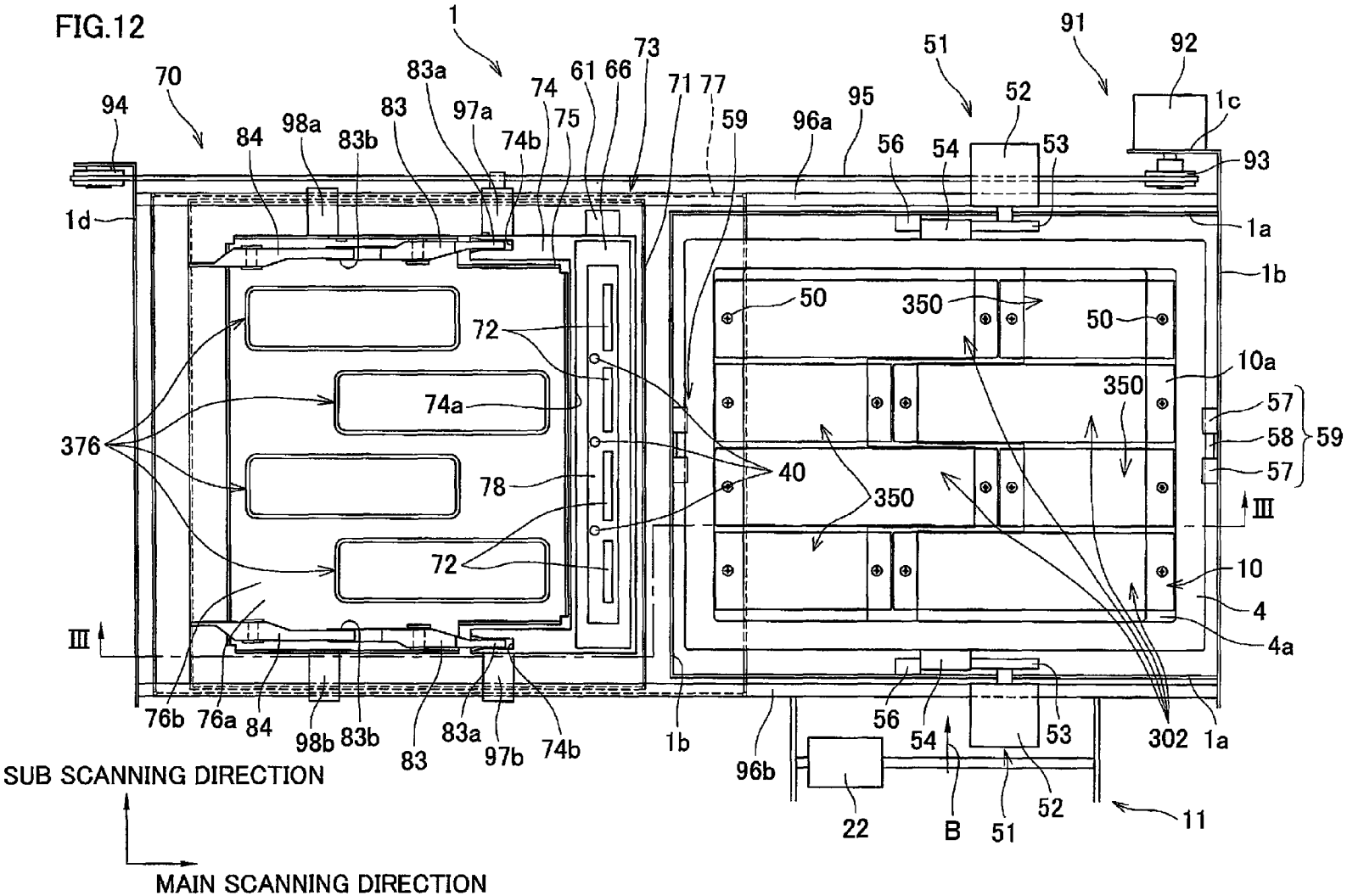
FIG. 12 is a partial plan view of an inkjet printer according to a third embodiment of the present invention.

Next, the following describes an inkjet printer according to a third embodiment with reference to FIGS. 12 and 13. The inkjet printer of the third embodiment has a similar structure to that of the first embodiment, except that inkjet heads 302 and caps 376 have different structures from those in the inkjet printer of the first embodiment, and that filler plates 350 are additionally provided. The same components as in the first and second embodiments will be given the same reference numerals, and the description thereof will be omitted.

As shown in FIGS. 12 and 13, the four inkjet heads 302 of the third embodiment are arranged in a staggered fashion. More specifically, ejection faces 302*a* are arranged into two rows each row having two ejection faces 302 arranged in the sub scanning direction. The ejection faces 302*a* of each row are positioned so that, when viewed from the main scanning direction, each ejection face 302*a* in one row does not overlap each ejection face 302*a* in the other row. The inkjet heads 302 are arranged so that ejection openings 303*b* are arranged at the same intervals with regard to the main scanning direction across two inkjet heads 302 adjacent in the sub scanning direction.

To be more specific, explanation will be given, just for example, with regard to one inkjet head 302 closest to the timing belt 95 and another inkjet head 302 adjacent thereto in the sub scanning direction. For these to two inkjet heads 302, the distance in the main scanning direction between (a) an ejection opening 303*b* of the one inkjet head 302, which opening is closest to the other inkjet head 302 (in FIG. 12, the most bottom right ejection opening 303*b* of the upper left inkjet head 302) and (b) an ejection opening 303*b* of the other inkjet head 302, which opening is closest to the one inkjet head 302 (in FIG. 12, the most top left ejection opening 303*b* of the upper right inkjet head 302) is equal to the nozzle pitch in the main scanning direction of the ejection openings 303*b* of each inkjet head 302. This is applied for the remaining two inkjet heads 302.

A nozzle plate 339 of each inkjet head 302 has a greater width in the sub scanning direction compared to plates 31 to 38, i.e., plates other than the nozzle plate 339, as is the case of the nozzle plate 39 of each inkjet head 2 of the first embodiment. Each end of the nozzle plate 339 in the sub scanning direction forms an inclined plane 339*a* which is inclined in a direction departing from a sheet conveyance mechanism 15. Note that each inclined plane 339*a* is bent at an angle such that an inclined plane 339*a* of one nozzle plate 339 does not overlap an inclined plane 339*a* of another nozzle plate 339 adjacent to the one nozzle plate 339.

Figure 13A:
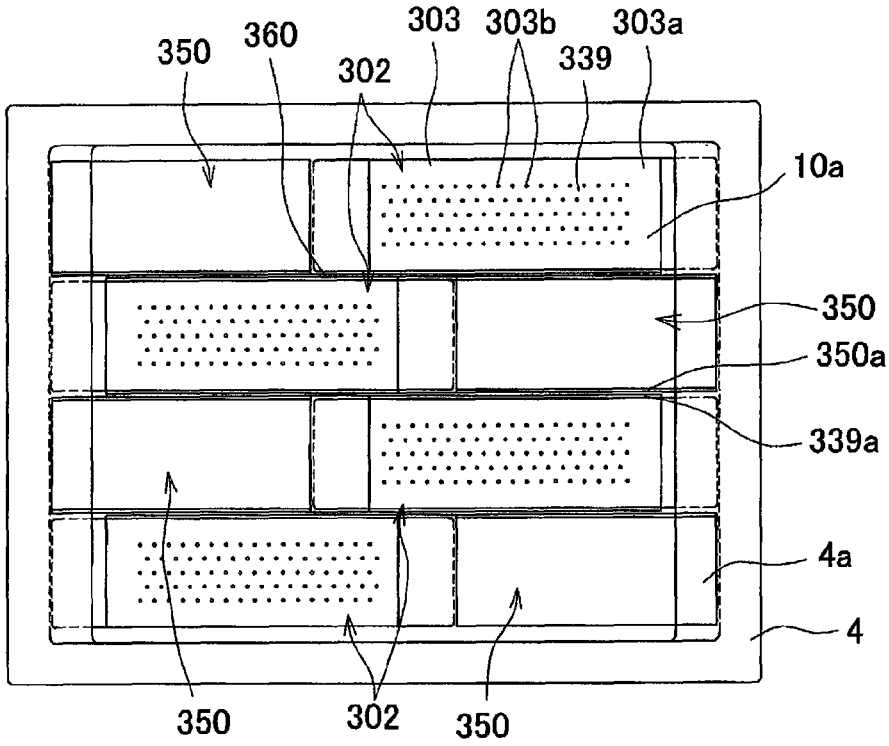
FIG. 13A is a plan view, viewed from below, of inkjet heads and a frame according to the third embodiment of the present invention.

As shown in FIGS. 12 and 13A, four filler plates 350 are disposed so that: when viewed from a sub scanning direction, each filler plate 350 overlaps inkjet heads 302 of the same row; and when viewed from the main scanning direction, each filler plate 350 overlaps an inkjet head 302 of the different row. In other words, among the four filler plates 350, one filler plate 350 of each row is disposed between two inkjet heads 302 of the same row so as to overlap an inkjet head 302 of the different row when viewed from the main scanning direction.

Figure 13B:
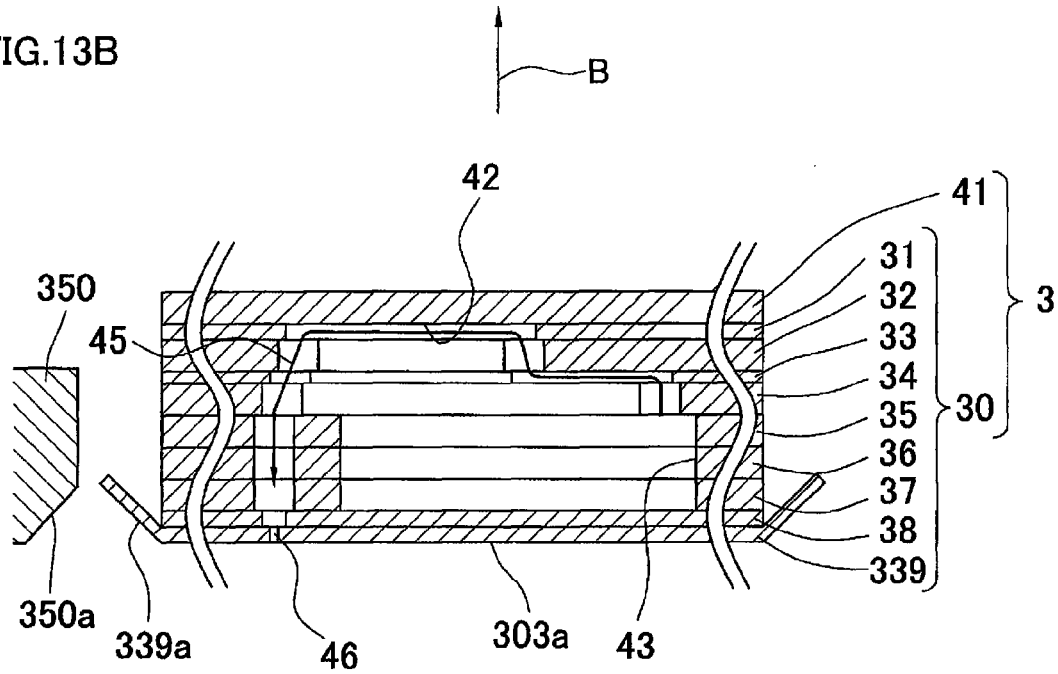
FIG. 13B is a longitudinal sectional view of an inkjet head in FIG. 13A.

Each filler plate 350 has a same width in the sub scanning direction as the width of each nozzle plate 339 in the sub scanning direction. As shown in FIG. 13B, each end of the filler plate 350 in the sub scanning direction forms an inclined plane 350*a* which is inclined in a direction departing from the sheet conveyance mechanism 15, at a same inclined angle as that of the inclined plane 339*a* of each nozzle plate 339.

The inclined planes 350*a* formed in each filler plate 350 smoothly continue to the respective inclined planes 339*a* formed on the nozzle plate 339 of an inkjet head 302 overlapping that filler plate 350 when viewed from the main scanning direction (see FIG. 13).

The four caps 376 are disposed in a staggered fashion corresponding to the four inkjet head 302 so that the caps 376 can cover the ejection faces 303*a* of the inkjet heads 302 respectively at a time of a purge process.

The following deals with a purge process performed in this embodiment for recovering the inkjet heads 302 having a problem such as poor ink ejection. As in the first embodiment, a frame 4 and the inkjet heads 302 first move to a head maintenance position. Then, the maintenance unit 70 moves to a maintenance position.

Then, moving the inkjet heads 302 downward causes the inclined planes 339*a* of the nozzle plates 339 or the inclined planes 350*a* of the filler plates 350 adjacent to the nozzle plates 339 contact leading ends of protrusions 40, respectively.

After that, further downward movement of the inkjet heads 302 causes each of the protrusions 40 intrudes into a gap between two inclined planes 339*a*, 350*a* adjacent to each other. At this time, a retaining plate 78 is supported by springs 79 on a mounting member 74, and therefore the retaining plate 78 is displaceable in the sub scanning direction. In spite of such a simple structure, each protrusion 40 is guided by an inclined plane 339*a* or inclined plane 350*a* being in contact with, thereby reaching a predetermined position between an inkjet head 302 and a filler plate 350. Then, the leading ends of wipers 72 abut the respective ejection faces 303*a* and the under surface of the frame 4. Here, the inclined planes 339*a* and the inclined planes 350*a* each formed in a gap between a nozzle plate 339 and a filler plate 350 adjacent to each other facilitates intrusion of the protrusions 40 into the gaps. In addition, the round shape of the leading end of each protrusion 40 further facilitates intrusion of each protrusion 40 into a gap between an inclined plane 339*a* and an inclined plane 350*a* adjacent to each other.

Then, a tray 71 is moved to the left, that is, from the maintenance position to a withdrawal position. This causes the four wipers 72 to respectively wipe the four ejection faces 303*a* associated therewith. At this time, each protrusion 40 intrudes into a gap between an inkjet head 302 and a filler plate 350 adjacent to each other, and the positions of the wiping-target region of the ejection faces 303*a* are respectively aligned with the positions of the wipers 72. In addition, the springs 79 interposed between the retaining plate 78 and the mounting member 74 serve as a cushion member for absorbing a force that may shift the retaining plate 78 in the sub scanning direction. Accordingly, the retaining plate 78 (including the wipers 72) is displaceable in the sub scanning direction relative to the mounting member 74. Therefore, even if the tray 71 having the mounting member 74 moves deviating from the main scanning direction, the retaining plate 78 does not move in a direction deviating from the main scanning direction. The protrusions 40 slide along the inclined planes 339*a* or inclined planes 350*a*, and movement of the wipers 72 in the sub scanning direction is restrained. Therefore the wipers 72 move in the main scanning direction. In this movement, the wipers 72 smoothly move in the main scanning direction because of the smooth and continuous portions that have been respectively formed of the inclined planes 339*a* of each nozzle plate 339 and the respective inclined planes 350*a* of a corresponding filler plate 350 which overlaps that nozzle plate 339 when viewed from the main scanning direction. In addition, the upper ends of the four wipers 72 are leveled higher than the under surfaces of the ejection faces 303*a*. Because of this, the wipers 72 respectively contact the four ejection faces 303*a* while being warped, and wipe off ink adhered to the four ejection faces 303*a* due to purging.

This inkjet printer of the above-described third embodiment where the inkjet heads 302 are arranged in a staggered fashion also brings about advantageous effects similar to those of the first embodiment. That is, it is possible to move each wiper 72 while ensuring that the wiper 72 entirely abuts the ejection face 303*a*, and to surely wipe out ink adhered to the ejection face 303*a* while maintaining the position of the wiper 72 relative to the ejection face 303*a*. Further, with a low-cost structure simply having the inclined planes 339*a* at both ends in the sub scanning direction of each nozzle plate 339 and having the inclined planes 350*a* at both ends in the sub scanning direction of each filler plate 350, the protrusions 40 are able to be smoothly guided along the main scanning direction. In addition, movement of the wipers 72 in the sub scanning direction is restrained simply by inserting each protrusion 40 between a nozzle plate 339 and a filler plate 350 adjacent to each other.

Fourth Embodiment

Figure 14:
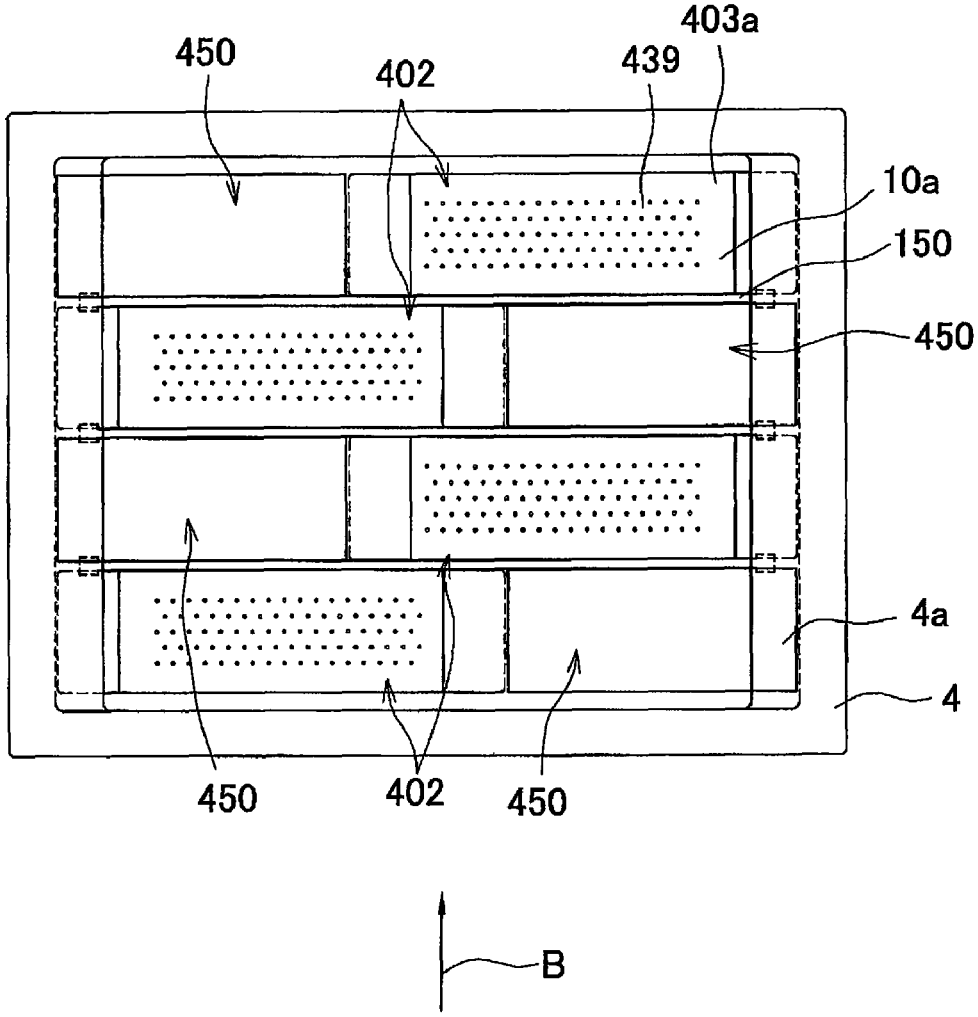
FIG. 14 is a plan view, viewed from below, of inkjet heads and a frame according to a fourth embodiment of the present invention.

Next, the following describes an inkjet printer according to a fourth embodiment with reference to FIG. 14. The inkjet printer of the fourth embodiment has a similar structure to that of the above-described embodiments, except that the guide plates 150 and the rollers 140 of the second embodiment are provided instead of the inclined planes 339*a* of the nozzle plates 339, the inclined planes 350*a* of the filler plates 350, and the protrusions 40, which are mentioned in the third embodiment. The same components as in the first to third embodiments will be given the same reference numerals, and the description thereof will be omitted.

A nozzle plate 439 of the fourth embodiment does not include the inclined planes 339*a* described in the third embodiment, and the nozzle plate 439 has a same width in the sub scanning direction as those of plates 31 to 38, i.e., plates other than the nozzle plate 439. As shown in FIG. 14, there are provided three guide plates 150 each of which has its length in the main scanning direction and is provided in a gap between a nozzle plate 439 of one inkjet head 402 and a flat filler plate 450 of another inkjet head 402 adjacent to the one inkjet head 402 in the sub scanning direction.

As shown in FIG. 14, the both longitudinal ends of each guide plate 150 are respectively fixed to flanges 4*a* of a frame 4 by thermal welding or the like. As in the second embodiment, each guide plate 150 gradually slopes down so that one longitudinal end thereof closer to a maintenance unit 70 in a withdrawal position is closer to a sheet conveyance mechanism 15 than the other end.

Also as in the second embodiment, a retaining plate 78 is provided with three support arms 141 which rotatably support the three rollers 140, respectively. The three support arms 141 are fixed on the retaining plate 78 along the sub scanning direction so as to be respectively in the same positions, in relation to the sub scanning direction, as the three guide plates 150 each of which is provided in a gap between a nozzle plate 439 of one inkjet head 402 and a filler plate 450 of another inkjet head 402 adjacent to the one inkjet head 402 in the sub scanning direction. Accordingly, each of the three rollers 140 is provided in a space between two wipers 72 adjacent to each other. The three rollers 140 are capable of rolling on and moving along the guide plates 150 (guide slots 150*a*), respectively.

The following deals with a purge process performed in this embodiment for recovering the inkjet heads 302 having a problem such as poor ink ejection. As in the second embodiment, the frame 4 and the inkjet heads 402 first move to a head maintenance position. Then, the maintenance unit 70 moves to a maintenance position.

Then, the inkjet heads 402 are moved downward. This causes each of the rollers 140 to intrude into a gap between a nozzle plate 439 of one inkjet head 402 and a filler plate 450 of another inkjet head 402 adjacent to that one inkjet head 402, while being displaced in the sub scanning direction because of the presence of springs 79 which allows the retaining plate 78 to be displaced in the sub scanning direction. As a result, each roller 140 is engaged with an associated guide plate 150. At this time, the leading ends of the wipers 72 abut respective ejection faces 403*a* and the under surface of the frame 4.

Then, a tray 71 is moved to the left, that is, from the maintenance position to the withdrawal position. This causes the four wipers 72 to respectively wipe the four ejection faces 403*a* associated therewith. During this operation, each roller 140 intrudes into a gap between a nozzle plate 439 of one inkjet head 402 and a filler plate 450 of another inkjet head 402 adjacent thereto, to achieve the engagement of each roller 140 with an associated guide plate 150, and the springs 79 allow the retaining plate 78 to be displaced in the sub scanning direction relative to a mounting member 74. Therefore, even if the tray 71 having the retaining plate 78 moves deviating from the main scanning direction, the engagement of the rollers 140 with the guide plates 150 ensures that the wipers 72 wipe wiping-target regions of the ejection faces 403*a*. In this operation, the springs 79 serve as a cushion member for absorbing a force that may shift the retaining plate 78 in the sub scanning direction. Therefore, the retaining plate 78 does not move in a direction deviating from the main scanning direction. In addition, since the upper ends of the four wipers 72 are leveled higher than the under surfaces of the respective ejection faces 403*a*, the wipers 72 respectively contact the four ejection faces 403*a* while being warped, and wipe off ink adhered to the four ejection faces 403*a* due to purging.

Here, each of the guide plates 150 gradually slopes down so that one longitudinal end thereof closer to a maintenance unit 70 in a withdrawal position is closer to the sheet conveyance mechanism 15 than the other end. Because of this structure, the closer the rollers 140 move toward the withdrawal position, the bigger pressing force is applied from the guide plates 150 toward the sheet conveyance mechanism 15. This pressing force causes the springs 79 to contract downward, and thereby the rollers 140 and the retaining plate 78 become closer to the sheet conveyance mechanism 15. As the retaining plate 78 becomes closer to the sheet conveyance mechanism 15, the wipers 72 also become closer to the sheet conveyance mechanism 15, and therefore the wipers 72 smoothly depart from the ejection faces 403*a* after wiping the ejection face 3*a*. This prevents ink from scattering when the wipers 72 depart from the ejection faces 403*a* after the wiping of the ejection faces 403*a* is finished.

This inkjet printer of the above-described fourth embodiment where the inkjet heads 402 are arranged in a staggered fashion also brings about advantageous effects similar to those of the first embodiment. That is, it is possible to move each wiper 72 while ensuring that the wiper 72 entirely abuts the corresponding ejection face 403*a*, and to surely wipe out ink adhered to the ejection face 403*a* while maintaining the position of the wiper 72 relative to the ejection face 403*a*. In addition, since the rollers 140 can roll and move along the guide plates 150, it is possible to surely move each of the rollers 140 along an associated guide plate 150 provided in a gap between a nozzle plate 439 of one inkjet head 402 and a filler plate 450 of another inkjet head 402 adjacent to the one inkjet head 402. This restrains the wipers 72 from moving in the sub scanning direction, and ensures that the wipers 72 are moved in the main scanning direction.

In the first and third embodiments, the three protrusions 40 are respectively provided, each protrusion 40 corresponding to a gap between two inkjet heads 2 adjacent to each other, or between a nozzle plate 339 and a filler plate 350 adjacent to each other. However, the advantageous effects of the present invention can be obtained with at least one protrusion being provided for a gap. This is applied for the rollers 140 of the above-described second and fourth embodiments.

Further, in the above-described first to fourth embodiments, the wipers 72 move with the caps 76 from the withdrawal position to the maintenance position when the caps 76 cover the ejection faces. However, the tray 71 and the tray 75 may be moved by different movement mechanisms, respectively. In this structure, since the wipers 72 do not move to the maintenance position at a time of capping the ejection faces, there is no need to consider moving the wipers 72 in the wiping direction when the caps 76 are in the maintenance position.

In addition, in the first to fourth embodiments, the springs 79 urge the wipers 72 via the retaining plate 78, and allow the wipers 72 to be displaced in the sub scanning direction relative to the mounting member 74; however, the present invention is not limited to this. Instead of an elastic member such as the springs 79, there may be separately provided a movement mechanism which moves the wipers 72 in the sub scanning direction and a movement mechanism which vertically moves the wipers 72.

In the above-described first and third embodiments, each wiper 72 and an adjacent protrusion 40 are separately provided. However, the protrusion 40 may be integrally formed with the wiper 72. This improves positioning accuracy between the wiper 72 and the protrusion 40.

Furthermore, in the above-described first and third embodiments, the protrusions 40 are guided along the inclined planes of the nozzle plates and the filler plates. However, the inclined planes may be omitted from the nozzle plates and the filler plates. Each of the protrusion 40 may be guided along the side faces of an associated nozzle plate and filler plate, by intruding into a gap between two adjacent nozzle plates or a gap between a nozzle plate and a filler plate adjacent to each other. Alternatively, it is possible to provide a guide member, along which the leading end of an associated protrusion 40 slides while abutting thereto, in a gap between two adjacent nozzle plates or a gap between a nozzle plate and a filler plate adjacent to each other.

In addition, in the above-described second and fourth embodiments, there are provided the guide plates 150 capable of being engaged with the rollers 140, respectively. However, the guide slots for such engagement are not necessarily required, as long as the rollers 140 can roll and move along the respective guide plates 150 while abutting the respective guide plates 150 without engagement.

Figure 15:
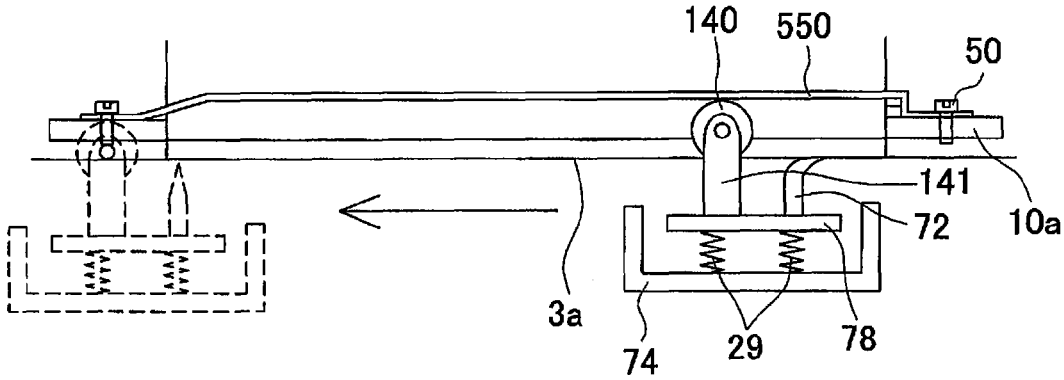
FIG. 15 is a view of a modification, illustrating wipers wiping ink adhered to ejection faces.

In the above-described second and fourth embodiments, each guide plate 150 gradually slopes down (from the right to the left in FIG. 10) so that one longitudinal end thereof closer to a maintenance unit 70 being in the withdrawal position is closer to the sheet conveyance mechanism 15 than the other end, as shown in FIG. 10. However, it may be possible to adopt a guide member 550 having a horizontal portion and a sloping portion as shown in FIG. 15, which guides an associated wiper 72 horizontally while the wiper 72 abuts a region of an ejection face where ejection openings are formed, and guides the wiper 72 in a direction approaching the sheet conveyance mechanism 15 while the wiper 72 faces another region of the ejection face where an ejection opening is not formed. According to this structure, it is possible, not only to prevent ink from scattering when the wiper 72 departs from the ejection face after wiping the ejection face, but also to wipe the ejection face with a constant upward pressing force during wiping operation of ink adhered to the ejection face.

Moreover, each of the above-described first to fourth embodiments is an exemplary application of the present invention to an inkjet printer having a plurality of inkjet heads each ejecting ink from nozzles; however, the application of the present invention is not limited to the inkjet heads. The present invention is applicable to various liquid ejection devices each having a plurality of liquid ejection heads, for example, a device for forming a fine wiring pattern on a substrate by ejecting conductive paste, a device for producing a high-definition display by ejecting organic light emitting materials onto a substrate, or a device for producing a microelectronic device such as an optical waveguide by ejecting optical plastics onto a substrate.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A liquid ejection device, comprising:

a conveyance mechanism which conveys a recording medium in one direction;

a plurality of liquid ejection heads each having an ejection face which has a plurality of ejection openings for ejecting liquid and faces the conveyance mechanism, the liquid ejection heads being arranged along the one direction;

a plurality of wipers which wipe the ejection faces of the liquid ejection heads, respectively;

a holder which holds the wipers;

a support which supports the holder; and a movement mechanism which moves the holder in a direction perpendicular to the one direction so that the wipers move in the perpendicular direction while abutting the ejection faces, respectively; wherein:

the holder is displaceable in the one direction relative to the support; and the holder has an intruder which intrudes into a gap between two liquid ejection heads adjacent to each other when the holder is moved by the movement mechanism in the perpendicular direction.

2. The liquid ejection device according to claim 1, wherein the intruder is integrally formed with the wipers.

3. The liquid ejection device according to claim 1, wherein, in the gap between two liquid ejection heads adjacent to each other, a guide member is provided which guides the intruder when the holder is moved by the movement mechanism in the perpendicular direction.

4. The liquid ejection device according to claim 3, wherein:

each of the liquid ejection heads has a passage unit having a plurality of laminated plates including a nozzle plate which has the ejection face;

the nozzle plate has a width in the one direction greater than those of the plates other than the nozzle plate;

each end part of the nozzle plate in the one direction has an inclined plane which is inclined relative to the ejection face in a direction departing from the conveyance mechanism;

the inclined plane constitutes the guide member; and the intruder is capable of sliding along the inclined plane while abutting the inclined plane when the holder is moved by the movement mechanism in the perpendicular direction.

5. The liquid ejection device according to claim 3, wherein:

the intruder is a roller provided between two wipers adjacent to each other and is rotatable about an axis extending in the one direction; and the roller is capable of rolling along the guide member while abutting the guide member when the holder is moved by the movement mechanism in the perpendicular direction.

6. The liquid ejection device according to claim 5, further comprising an elastic member which urges the holder so that the wipers abutting the ejection faces press the ejection faces respectively, wherein a guide face of the guide member, which abuts the roller, has a slope inclined relative to the ejection faces, the slope configured so that the holder becomes closer to the conveyance mechanism as the holder is moved greater distance by the movement mechanism in the perpendicular direction.

7. The liquid ejection device according to claim 1, wherein the intruder is a protrusion protruding between two wipers adjacent to each other.

8. The liquid ejection device according to claim 7, wherein the protrusion has a round leading end.

9. A liquid ejection device, comprising:

a conveyance mechanism which conveys a recording medium in one direction;

a plurality of liquid ejection heads each having an ejection face which has a plurality of ejection openings for ejecting liquid and faces the conveyance mechanism, the liquid ejection heads being arranged into two rows, in each of which two or more liquid ejection heads are arranged along the one direction, so that the liquid ejection heads do not overlap with one another when viewed from a direction perpendicular to the one direction and parallel to in-plane directions of the ejection faces;

a plurality of filler plates each of which is positioned adjacent to, in the one direction, at least one of the liquid ejection heads in a same row so as to overlap one of the liquid ejection heads in the other row when viewed from the perpendicular direction;

a plurality of wipers which wipe the ejection faces of the liquid ejection heads, respectively;

a holder which holds the wipers;

a support which supports the holder; and a movement mechanism which moves the holder in the perpendicular direction so that the wipers move in the perpendicular direction while abutting the ejection faces, respectively, wherein:

the holder is displaceable in the one direction relative to the support; and the holder has an intruder which intrudes into a gap between a liquid ejection head and a filler plate adjacent to each other when the holder is moved by the movement mechanism in the perpendicular direction.

10. The liquid ejection device according to claim 9, wherein the intruder is integrally formed with the wipers.

11. The liquid ejection device according to claim 9, wherein, in the gap between the liquid ejection head and the filler plate adjacent to each other, a guide member is provided which guides the intruder intruding into the gap when the holder is moved by the movement mechanism in the perpendicular direction.

12. The liquid ejection device according to claim 11, wherein:

each of the liquid ejection heads has a passage unit having a plurality of laminated plates including a nozzle plate which has the ejection face;

the nozzle plate has a width in the one direction greater than those of the plates other than the nozzle plate;

each end part of the nozzle plate in the one direction and each end part of an associated filler plate in the one direction respectively have inclined planes each of which is inclined relative to the ejection face in a direction departing from the conveyance mechanism;

the inclined planes constitute the guide member; and the intruder is capable of sliding along the inclined planes while abutting the inclined planes when the holder is moved by the movement mechanism in the perpendicular direction.

13. The liquid ejection device according to claim 11, wherein:

the intruder is a roller provided between two wipers adjacent to each other and is rotatable about an axis extending in the one direction; and the roller is capable of rolling along the guide member while abutting the guide member when the holder is moved by the movement mechanism in the perpendicular direction.

14. The liquid ejection device according to claim 13, further comprising an elastic member which urges the holder so that the wipers abutting the ejection faces press the ejection faces respectively, wherein a guide face of the guide member, which abuts the roller, has a slope inclined relative to the ejection faces, the slope configured so that the holder becomes closer to the conveyance mechanism as the holder is moved greater distance by the movement mechanism in the perpendicular direction.

15. The liquid ejection device according to claim 9, wherein the intruder is a protrusion protruding between two wipers adjacent to each other.

16. The liquid ejection device according to claim 15, wherein the protrusion has a round leading end.

* * * * *